US009232336B2

(12) United States Patent
Nishio et al.

(10) Patent No.: US 9,232,336 B2
(45) Date of Patent: Jan. 5, 2016

(54) HEAD RELATED TRANSFER FUNCTION GENERATION APPARATUS, HEAD RELATED TRANSFER FUNCTION GENERATION METHOD, AND SOUND SIGNAL PROCESSING APPARATUS

(75) Inventors: Ayataka Nishio, Kanagawa (JP); Takao Fukui, Tokyo (JP)

(73) Assignee: SONY CORPORATION, Tokyo (JP)

( * ) Notice: Subject to any disclaimer, the term of this patent is extended or adjusted under 35 U.S.C. 154(b) by 400 days.

(21) Appl. No.: 13/154,906

(22) Filed: Jun. 7, 2011

(65) Prior Publication Data

US 2011/0305358 A1 Dec. 15, 2011

(30) Foreign Application Priority Data

Jun. 14, 2010 (JP) ..... 2010-135291

(51) Int. Cl.
*H04R 5/00* (2006.01)
*H04R 5/02* (2006.01)
*H04S 7/00* (2006.01)

(52) U.S. Cl.
CPC ..... *H04S 7/305* (2013.01); *H04S 2420/01* (2013.01)

(58) Field of Classification Search
CPC ... H04S 2420/00; H04S 2420/01; H04S 1/00; H04S 1/002; H04S 1/005; H04S 3/00; H04S 3/002; H04S 3/004; H04S 7/305
USPC ..... 381/1, 2, 17–23, 74, 63, 66, 71.6, 92, 381/306, 307, 309, 310, 313, 303
See application file for complete search history.

(56) References Cited

U.S. PATENT DOCUMENTS

| | | | | |
|---|---|---|---|---|
| 4,731,848 | A | 3/1988 | Kendall et al. | |
| 5,181,248 | A | 1/1993 | Inanaga et al. | |
| 5,440,639 | A | 8/1995 | Suzuki et al. | |
| 5,717,767 | A | 2/1998 | Inanaga et al. | |
| 5,844,816 | A | 12/1998 | Inanaga et al. | |
| 6,243,476 | B1 * | 6/2001 | Gardner | 381/303 |
| 6,501,843 | B2 | 12/2002 | Usui et al. | |
| 6,738,479 | B1 | 5/2004 | Sibbald et al. | |

(Continued)

FOREIGN PATENT DOCUMENTS

| | | | |
|---|---|---|---|
| EP | 1 545 154 | A2 | 6/2005 |
| EP | 2096882 | * | 2/2009 |

(Continued)

OTHER PUBLICATIONS

Sun Power, "Power and Voltage Relation", Feb. 2008, p. 2.*

(Continued)

*Primary Examiner* — Vivian Chin
*Assistant Examiner* — William A Jerez Lora
(74) *Attorney, Agent, or Firm* — Hazuki International, LLC

(57) ABSTRACT

A head related transfer function generation apparatus includes a first input unit that inputs a first head related transfer function generated in a first measurement environment, a second input unit that inputs a second head related transfer function generated in a second measurement environment, and a transform normalization processing unit that normalizes a first gain of the first head related transfer function represented in frequency-axis data with a second gain of the second head related transfer function represented in frequency-axis data and also calculates a square root thereof.

12 Claims, 21 Drawing Sheets

(56) References Cited

U.S. PATENT DOCUMENTS

| | | | | |
|---|---|---|---|---|
| 6,801,627 | B1 | 10/2004 | Kobayashi | |
| 8,503,682 | B2 | 8/2013 | Fukui et al. | |
| 8,520,857 | B2 | 8/2013 | Fukui et al. | |
| 2004/0136538 | A1 * | 7/2004 | Cohen et al. | 381/17 |
| 2005/0047619 | A1 | 3/2005 | Murata et al. | |
| 2005/0135643 | A1 | 6/2005 | Lee et al. | |
| 2006/0045294 | A1 | 3/2006 | Smyth | |
| 2006/0115091 | A1 | 6/2006 | Kim et al. | |
| 2007/0160217 | A1 | 7/2007 | Chun | |
| 2008/0273708 | A1 * | 11/2008 | Sandgren et al. | 381/63 |
| 2009/0010440 | A1 | 1/2009 | Jung et al. | |
| 2009/0028345 | A1 | 1/2009 | Jung et al. | |
| 2009/0043591 | A1 | 2/2009 | Breebaart et al. | |
| 2009/0060205 | A1 | 3/2009 | Jung et al. | |
| 2009/0208022 | A1 | 8/2009 | Fukui et al. | |
| 2009/0214045 | A1 | 8/2009 | Fukui et al. | |
| 2010/0322428 | A1 | 12/2010 | Fukui et al. | |
| 2011/0128821 | A1 * | 6/2011 | Choi et al. | 367/118 |
| 2011/0135098 | A1 | 6/2011 | Kuhr et al. | |
| 2011/0176684 | A1 | 7/2011 | Katayama | |
| 2011/0286601 | A1 | 11/2011 | Fukui et al. | |
| 2013/0287235 | A1 | 10/2013 | Fukui et al. | |

FOREIGN PATENT DOCUMENTS

| | | | |
|---|---|---|---|
| EP | 2096882 | A2 | 9/2009 |
| JP | 61-245698 | A | 10/1986 |
| JP | 03-214897 | | 9/1991 |
| JP | 5-260590 | A | 10/1993 |
| JP | 6-147968 | A | 5/1994 |
| JP | 06-165299 | A | 6/1994 |
| JP | 06-181600 | A | 6/1994 |
| JP | 07-288899 | A | 10/1995 |
| JP | 07-312800 | A | 11/1995 |
| JP | 08-047078 | * | 2/1996 |
| JP | 8-047078 | A | 2/1996 |
| JP | 8-182100 | A | 7/1996 |
| JP | 09-037397 | A | 2/1997 |
| JP | 09-135499 | A | 5/1997 |
| JP | 09-187100 | A | 7/1997 |
| JP | 09-200898 | A | 7/1997 |
| JP | 09-284899 | A | 10/1997 |
| JP | 10-042399 | A | 2/1998 |
| JP | 11-313398 | | 11/1999 |
| JP | 2000-036998 | A | 2/2000 |
| JP | 2001-285998 | A | 10/2001 |
| JP | 2002-191099 | A | 7/2002 |
| JP | 2002-209300 | A | 7/2002 |
| JP | 2003-061196 | A | 2/2003 |
| JP | 2003-061200 | A | 2/2003 |
| JP | 2004-080668 | A | 3/2004 |
| JP | 2005-157278 | A | 6/2005 |
| JP | 2006-352728 | A | 12/2006 |
| JP | 2007-202021 | A | 8/2007 |
| JP | 2007-240605 | A | 9/2007 |
| JP | 2007-329631 | A | 12/2007 |
| JP | 2008-311718 | A | 12/2008 |
| WO | WO 95/13690 | A1 | 5/1995 |
| WO | WO 95/23493 | A1 | 8/1995 |
| WO | WO 01/31973 | A1 | 5/2001 |

OTHER PUBLICATIONS

Kendall et al. A Spatial Sound Processor for Loudspeaker and Headphone Reproduction. Journal of the Audio Engineering Society, May 30, 1990, vol. 8 No. 27, pp. 209-221, New York, NY.

Speyer et al., A Model Based Approach for Normalizing the Head Related Transfer Function. IEEE. 1996; 125-28.

* cited by examiner

HEAD RELATED TRANSFER FUNCTION GENERATION APPARATUS, HEAD RELATED TRANSFER FUNCTION GENERATION METHOD, AND SOUND SIGNAL PROCESSING APPARATUS

BACKGROUND

The present disclosure relates to a head related transfer function generation apparatus, a head related transfer function generation method, and a sound signal processing apparatus which are suitable, for example, to be applied to a television apparatus that adjusts a sound image position of a sound reproduced by a mounted speaker.

Up to now, in a television apparatus or an amplifier apparatus or the like that is connected to the television apparatus, one utilizing a technology called virtual sound image localization for virtually localizing a sound source of a reproduced sound at a desired position has been proposed.

This virtual sound image localization is for virtually localizing a sound image at a previously supposed position, for example, when sounds are reproduced by left and right speakers and the like arranged in the television apparatus, and to be more specific, the virtual sound image localization is realized through the following technique.

For example, a case is supposed in which stereo signals in left and right channels are reproduced by the left and right speakers arranged in the television apparatus.

As illustrated in FIG. 1, first, a head related transfer function is measured in a predetermined measurement environment. To be more specific, microphones ML and MR are installed at locations (measurement point positions) in the vicinity of both ears of a listener. Also, speakers SPL and SPR are arranged at positions where the virtual sound image localization is desired to be realized. At this time, the speaker is an example of an electro-acoustic transduction unit, and the microphone is an example of an acousto-electric transduction unit.

Then, in a state in which a dummy head DH (or which may be a human being, in this instance, a listener itself) exists, first, for example, sound reproduction of an impulse is carried out by the speaker SPL in one channel, for example, in the left channel. Then, the impulse emitted by the sound reproduction is picked up by each of the microphones ML and MR to measure a head related transfer function for the left channel. In the case of this example, the head related transfer function is measured as an impulse response.

At this time, as illustrated in FIG. 1, the impulse response serving as the head related transfer function for the left channel includes an impulse response HLd where a sound wave from the speaker SPL is picked up by the microphone ML (hereinafter, which will be referred to as impulse response of a left main component) and an impulse response HLc where a sound wave from the speaker SPL is picked up by the microphones MR (hereinafter, which will be referred to as impulse response of a left cross talk component).

Next, sound reproduction of an impulse is similarly carried out by the speaker SPR in the right channel, and the impulse emitted by the sound reproduction is picked up by each of the above-mentioned microphones ML and MR. Then, a head related transfer function for the right channel, in this instance, an impulse response for the right channel is measured.

At this time, the impulse response serving as the head related transfer function for the right channel includes an impulse response HRd where a sound wave from the speaker SPR is picked up by the microphones MR (hereinafter, which will be referred to as impulse response of a right main component) and an impulse response HRc where a sound wave from the speaker SPR is picked up by the microphone ML (hereinafter, which will be referred to as impulse response of a right cross talk component).

Then, the television apparatus convolves the impulse response of each of the head related transfer function for the left channel and the head related transfer function for the right channel as it is by applying a sound signal processing on the sound signal supplied to each of the left and right speakers.

That is, the television apparatus convolves the head related transfer function for the left channel obtained through the measurement, that is, the impulse response HLd of the left main component and the impulse response HLc of the left cross talk component with respect to the sound signal in the left channel as it is.

Also, the television apparatus convolves the head related transfer function for the right channel obtained through the measurement, that is, the impulse response HRd of the right main component and the impulse response HRc of the right cross talk component with respect to the sound signal in the right channel as it is.

With this configuration, although the sound reproduction is carried out by the left and right speakers, for example, in the case of the left and right two-channel stereo sounds, the television apparatus can realize the sound image localization (virtual sound image localization) as if the sound reproduction is carried out by left and right speakers installed at desired positions in front of the listener.

In this manner, in the virtual sound image localization, the head related transfer function in a case where the sound waves output from the speakers at desired positions are picked up by the microphones at desired positions is measured in advance, and the head related transfer function is set to be convolved to the sound signals.

Incidentally, in a case where the head related transfer function is measured, an acoustic characteristic of the speaker or the microphone itself affects the relevant head related transfer function. For this reason, even when the sound signal processing is applied on the sound signals by using the above-mentioned head related transfer function, the television apparatus may not realize the sound image localization at the desired positions in some cases.

In view of the above, as the head related transfer function measurement method, a method of normalizing a head related transfer function obtained in a state in which the dummy head DH or the like exists by a transfer pristine state characteristic in a state in which the dummy head DH or the like does not exist is proposed (for example, see Japanese Unexamined Patent Application Publication No. 2009-194682 (FIG. 1)).

According to this head related transfer function measurement method, it is possible to eliminate the acoustic characteristic of the speaker or the microphone itself, and a highly accurate sound image localization can be obtained.

SUMMARY

Incidentally, in a case where the thus measured head related transfer function is convolved to the sound signal, if this is output from the speaker and the sound is listened to, the sound tends to be more emphasized as compared to a case where the speaker is installed at a desired position, that is, the sound tends to spread too widely.

At this time, for example, it is also conceivable that the sense of emphasis in the sound can be reduced by correcting the sound signal with use of an equalizer or the like in the television apparatus. However, in this case, as the head related transfer function to be convolved is also changed, a problem occurs that the sound image desired by the listener may not be appropriately localized.

The present disclosure has been made while taking the above-mentioned points into account, and it is desired to propose a head related transfer function generation apparatus and a head related transfer function generation method in which a highly accurate head related transfer function may be generated and a sound signal processing apparatus that can obtain a desired sense of virtual sound image localization on the basis of the highly accurate head related transfer function.

In a head related transfer function generation apparatus and a related transfer function generation method according to an embodiment of the present disclosure, a first head related transfer function generated in a first measurement environment and a second head related transfer function generated in a second measurement environment are input, and a first gain of the first head related transfer function represented in frequency-axis data is normalized with a second gain of the second head related transfer function represented in frequency-axis data and also a square root thereof is calculated.

With the head related transfer function generation apparatus and the related transfer function generation method according to the embodiment of the present disclosure, since a zero level as a reference can be decided by normalizing the head related transfer function, it is possible to generate the normalized head related transfer function transformed from the dimension of the power into the dimension of the voltage through a simple computation such as a calculation of the square root.

Also, a sound signal processing apparatus according to an embodiment of the present disclosure includes a first input unit that inputs a first head related transfer function generated in a first measurement environment; a second input unit that inputs a second head related transfer function generated in a second measurement environment; a transform normalization processing unit that normalizes a first gain of the first head related transfer function represented in frequency-axis data with a second gain of the second head related transfer function represented in frequency-axis data and also calculates a square root thereof to generate a transform normalized gain; a head related transfer function generation unit that generates a normalized head related transfer function represented in time-axis data on the basis of the transform normalized gain; and a convolution processing unit that convolves the normalized head related transfer function to a sound signal.

With the sound signal processing apparatus according to the embodiment of the present disclosure, since a zero level as a reference can be decided by normalizing the head related transfer function, it is possible to convolve the normalized head related transfer function transformed from the dimension of the power into the dimension of the voltage through a simple computation such as a calculation of the square root to the sound signal.

According to the present disclosure, since the zero level as a reference can be decided by normalizing the head related transfer function, it is possible to generate the normalized head related transfer function transformed from the dimension of the power into the dimension of the voltage through the simple computation such as the calculation of the square root. In this manner, according to the embodiment of the present disclosure, it is possible to realize the head related transfer function generation apparatus and the related transfer function generation method in which the highly accurate head related transfer function may be generated.

Also, according to the present disclosure, since the zero level as a reference can be decided by normalizing the head related transfer function, it is possible to convolve the normalized head related transfer function transformed from the dimension of the power into the dimension of the voltage through the simple computation such as the calculation of the square root to the sound signal. In this manner, according to the embodiment of the present disclosure, it is possible to realize the sound signal processing apparatus in which the desired sense of virtual sound image localization can be obtained by the highly accurate head related transfer function.

DETAILED DESCRIPTION OF EMBODIMENTS

Hereinafter, embodiments of the present disclosure (hereinafter, which will be referred to as embodiments) will be described while using the drawings. It should be noted that the description will be given in the following order.

1. Basic principle of the present disclosure
2. First Embodiment (example in which a normalization processing is carried out only in one stage)
3. Second Embodiment (example in which the normalization processing is carried out in two stages)
4. Other Embodiments

1. Basic Principle of the Present Disclosure

Prior to embodiments, herein, a basic principle of the present disclosure will be described.

1-1. Measurement of Head Related Transfer Function

Figure 2A:
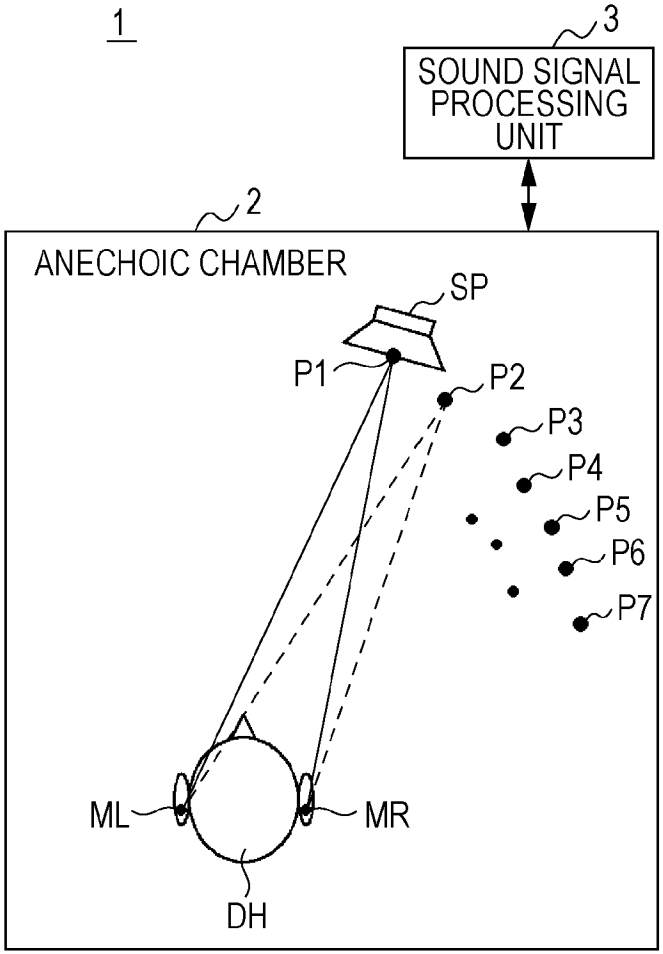
FIGS. 2A and 2B are outlined diagrams used for describing a measurement of the head related transfer function.
Figure 2B:
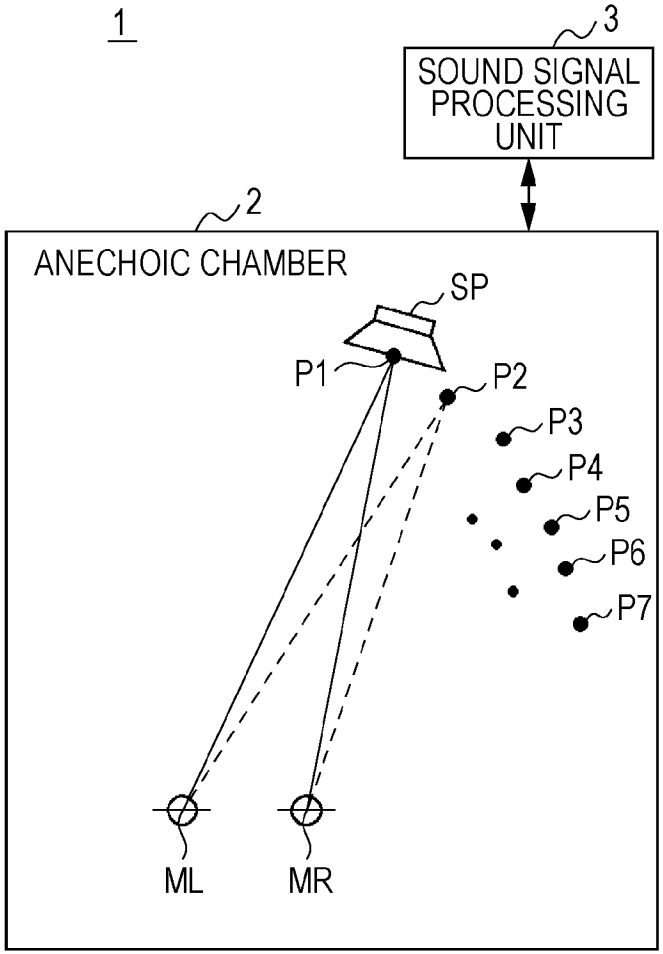

According to the present disclosure, a head related transfer function is set to be previously measured by a head related transfer function measurement system 1 illustrated in FIGS. 2A and 2B with regard to only direct waves except for reflective waves from a particular sound source.

The head related transfer function measurement system 1 has a dummy head DH, a speaker SP, and microphones ML and MR respectively installed at predetermined positions in an anechoic chamber 2.

The anechoic chamber 2 is designed to absorb sounds in a manner that sound waves are not reflected on a wall surface, a ceiling surface, and a floor surface. For this reason, in the anechoic chamber 2, only the direct waves from the speaker SP can be picked up by the microphones ML and MR.

The dummy head DH is structured to have a shape imitating a listener (that is, a human body) and is installed at a listening position of the relevant listener. The microphones ML and MR functioning as a sound pickup unit that picks up sound waves for measurement are respectively installed at measurement point positions equivalent to the inside of the ear conchs of the listener's ears.

The speaker SP functioning as a sound source that generates the sound waves for measurement is installed at a position separated at a predetermined distance in a direction where the head related transfer function is to be measured while the listening position or the measurement point position is set as a base point (for example, a position P1). Hereinafter, the position where the speaker SP is installed in this manner is referred to as assumed sound source direction position.

A sound signal processing unit 3 is adapted to be able to generate an arbitrary sound signal to be supplied to the speaker SP and also obtain sound signals based on the sounds respectively picked up by the microphones ML and MR and apply a predetermined signal processing thereon.

For reference's sake, the sound signal processing unit 3 is adapted to generate, for example, digital data of 8192 samples with a sampling frequency of 96 [kHz].

First, as illustrated in FIG. 2A, in a state in which the dummy head DH exists, the head related transfer function measurement system 1 supplies an impulse serving as the sound waves for measurement of the head related transfer function from the sound signal processing unit 3 to the speaker SP to reproduce the relevant impulse.

Also, in the head related transfer function measurement system 1, the impulse responses are respectively picked up by the microphones ML and MR, and the generated sound signals are supplied to the sound signal processing unit 3.

Figure 3B:
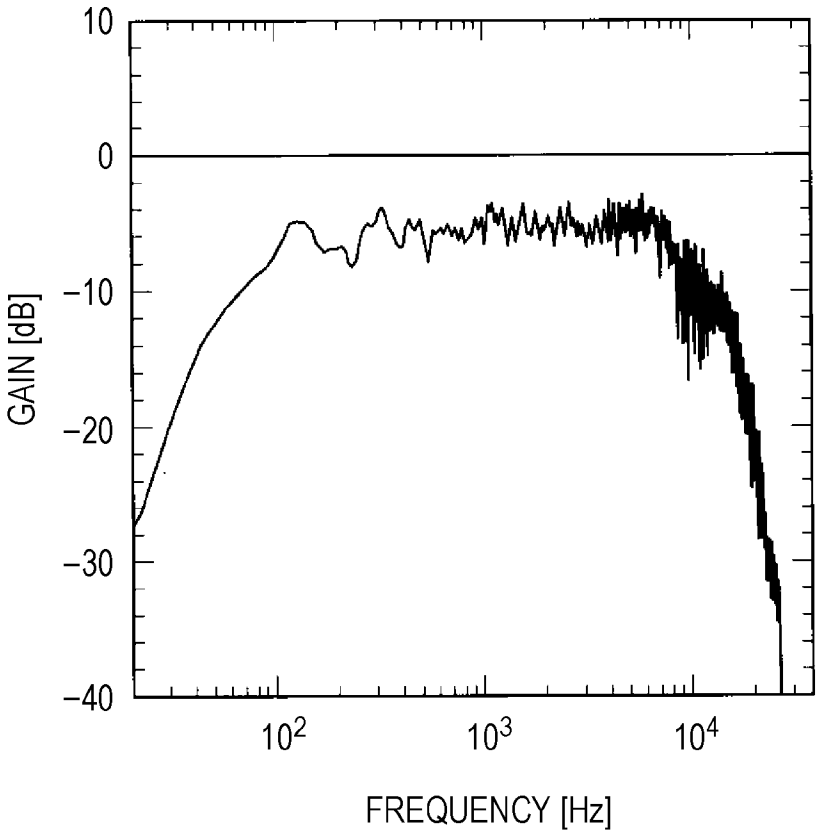
FIGS. 3A and 3B are outlined diagrams illustrating the head related transfer function and a pristine state transfer characteristic.
Figure 3A:
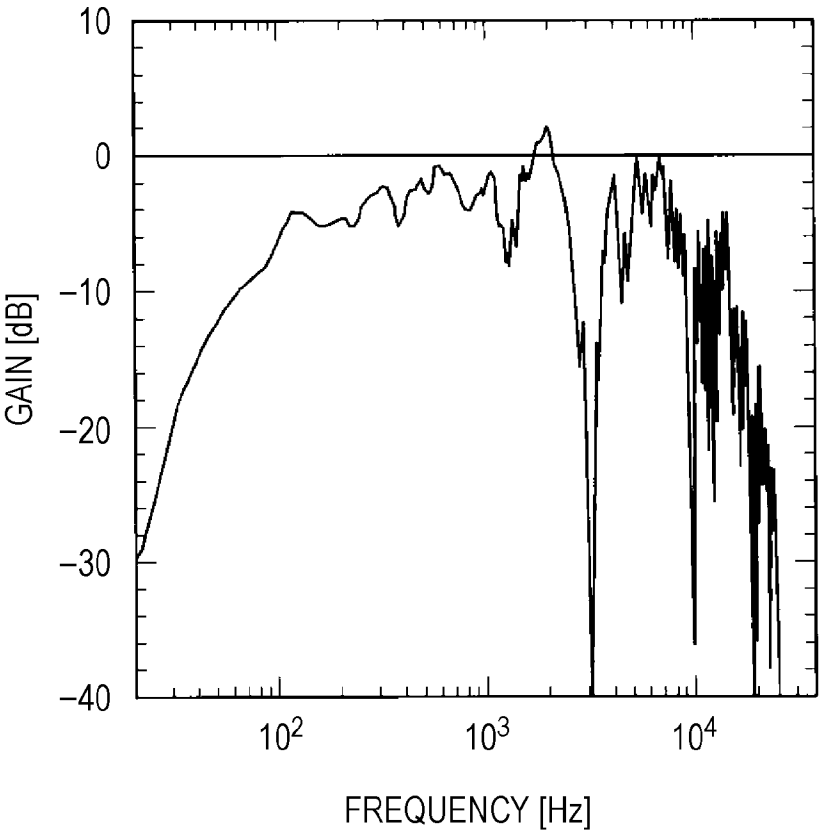

Herein, the impulse responses obtained from the microphones ML and MR represent a head related transfer function H at the assumed sound source direction position of the speaker SP and, for example, have characteristics illustrated in FIG. 3A. For reference's sake, FIG. 3A represents the characteristics of the impulse response which is the time-axis data is transformed into the frequency-axis data.

Figure 1:
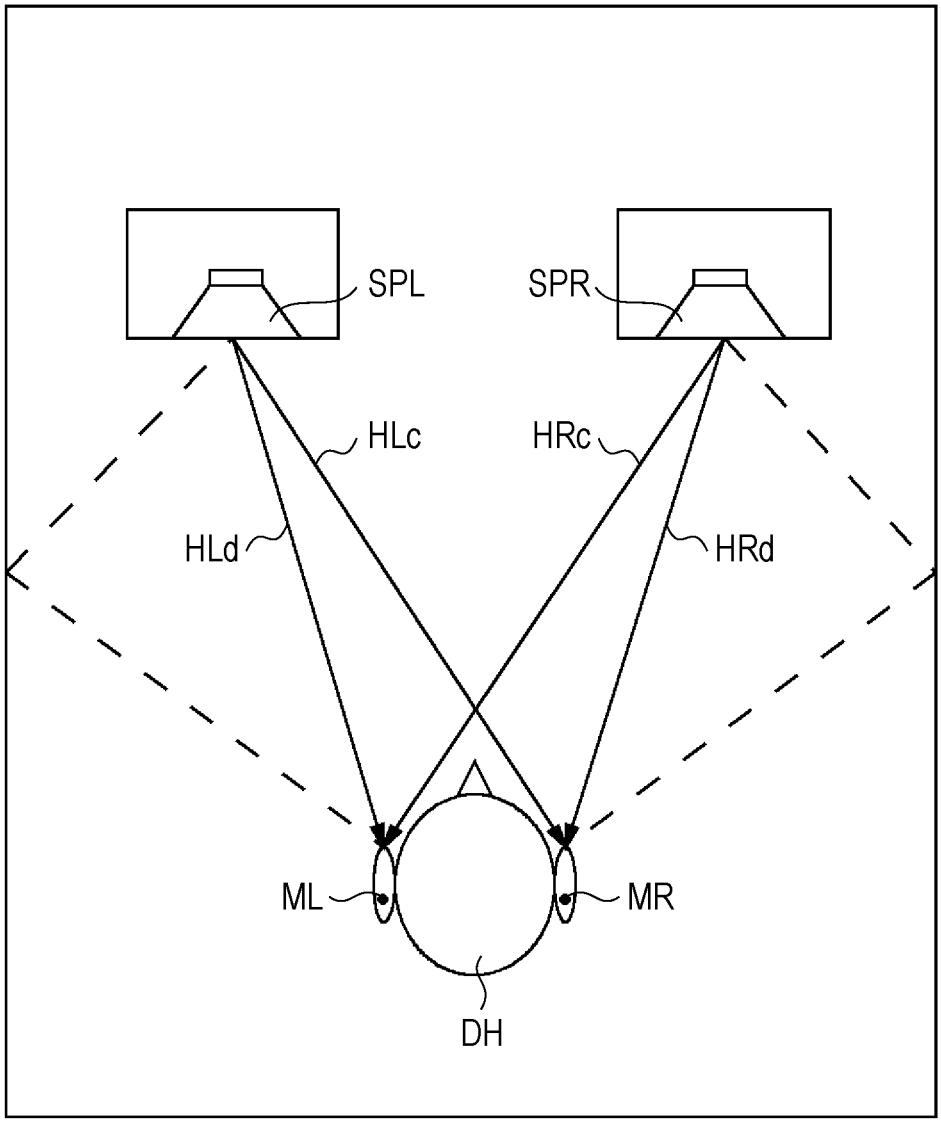
FIG. 1 is an outlined diagram illustrating a measurement environment for a head related transfer function in related art.

Incidentally, in the anechoic chamber 2, the speaker SP is installed on the right side of the dummy head DH (FIG. 2A). For this reason, the impulse response which is obtained by the microphones MR installed on the right side of the dummy head DH is equivalent to the impulse response HRd of the right main component (FIG. 1), and the impulse response which is obtained by the microphone ML is equivalent to the impulse response HRc of the right cross talk component (FIG. 1).

In this manner, first, in a measurement environment where the dummy head DH exists in the anechoic chamber 2, the head related transfer function measurement system 1 is adapted to measure the head related transfer function H of only the direct waves at the assumed sound source direction position.

Next, as illustrated in FIG. 2B, in a state in which the dummy head DH is removed, similarly, the head related transfer function measurement system 1 supplies the impulse from the sound signal processing unit 3 to the speaker SP to reproduce the relevant impulse.

Also, in the head related transfer function measurement system 1, similarly, the impulse responses are respectively picked up by the microphones ML and MR, and the generated sound signals are supplied to the sound signal processing unit 3.

Herein, the impulse responses obtained from the microphones ML and MR represent a pristine state transfer function T where the dummy head DH, an obstacle, or the like does not exist at the assumed sound source direction position of the speaker SP and becomes, for example, a characteristic illustrated in FIG. 3B corresponding to FIG. 3A.

This pristine state transfer characteristic T represents a characteristic of a measurement system based on the speaker SP and the microphones ML and MR where an influence of the dummy head DH is eliminated.

In this manner, the head related transfer function measurement system 1 is adapted to measure the pristine state transfer function T of only the direct waves at the assumed sound source direction position in the measurement environment where the dummy head DH does not exist in the anechoic chamber 2.

Furthermore, the head related transfer function measurement system 1 sets positions P2, P3, . . . angled at every 10 degrees in the horizontal direction as measurement point positions while the listening position is set as the base point and measures the head related transfer function in the state in which the dummy head DH exists and the pristine state transfer characteristic in the state in which the relevant dummy head DH does not exist respectively.

For reference's sake, in the head related transfer function measurement system 1, similarly as in the case of FIG. 1, with regard to the direct waves, the head related transfer function of the main component and the pristine state transfer characteristics and the head related transfer function of the left and right cross talk components and the pristine state transfer characteristics can be obtained from each of two pieces of the microphones ML and MR.

1-2. Elimination of Influences of Microphone and Speaker (Measurement Normalization Processing)

Next, elimination of the influences of the microphone and the speaker included in the head related transfer function will be described.

In a case where the head related transfer function H and the pristine state transfer function T are measured by using the microphones ML and MR and the speaker SP, in the head related transfer function H and the pristine state transfer function T, as described above, the influences of the microphones ML and MR as well as the speaker SP are included in each of them.

In view of the above, similarly as in the technique disclosed in Japanese Unexamined Patent Application Publication No. 2009-194682, according to the present disclosure, by normalizing the head related transfer function H by the pristine state transfer characteristic T (hereinafter, which will also be referred to as measurement normalization), a normalized head related transfer function HN from which the influences of the microphones and the speaker are eliminated is set to be generated.

For reference's sake, herein, for simplification, a description will be on given on a normalization processing only on the main component, and a description will be omitted with regard to the cross talk.

Figure 4:
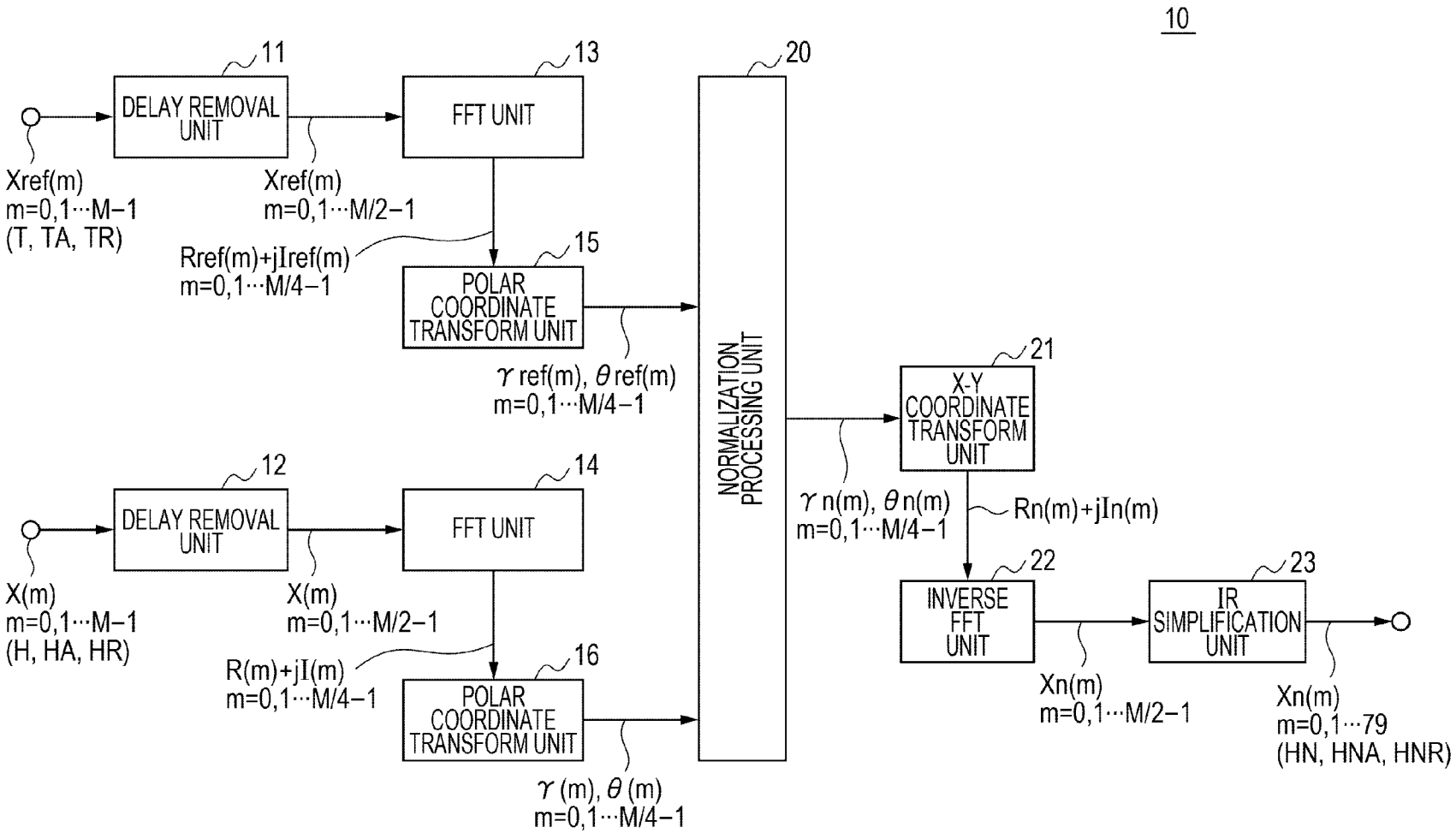
FIG. 4 is an outlined block diagram illustrating a configuration of a normalization processing circuit.

FIG. 4 is a block diagram illustrating a configuration of a normalization processing circuit 10 that performs a normalization processing of a head related transfer function.

A delay removal unit 11 obtains data representing only the pristine state transfer characteristic T of the direct waves at the assumed sound source direction position from the sound signal processing unit 3 of the head related transfer function measurement system 1 (FIGS. 2A and 2B). Hereinafter, data representing this pristine state transfer characteristic T is denoted as Xref(m) (where m=0, 1, 2, . . . , M−1 (M=8192)).

Also, a delay removal unit 12 obtains data representing the head related transfer function H of only the direct waves at the assumed sound source direction position from the sound signal processing unit 3 in the head related transfer function measurement system 1. Hereinafter, the data representing the head related transfer function H is denoted as X(m).

The delay removal units 11 and 12 respectively eliminate data of the head parts from a time point when the impulse is started to be reproduced in the speaker SP, by a delay time equivalent to a time used by the sound waves from the speaker SP installed at the assumed sound source direction position to reach the microphones MR.

With this configuration, the normalized head related transfer function generated in the end has no relation to a distance between the position of the speaker SP that generates the impulse (that is, the assumed sound source direction position) and the position of the microphone that picks up the impulse (that is, the measurement point position). In other words, the normalized head related transfer function to be generated becomes a head related transfer function corresponding only to the direction of an assumed sound source direction position as seen from the measurement point position that picks up the impulse.

Also, the delay removal units 11 and 12 deletes each of the data Xref(m) of the pristine state transfer characteristic T and the data X(m) of the head related transfer function H so that a data count is the power of 2 in keeping with the an orthogonal transform of time-axis data into frequency-axis data in a next stage to be respectively supplied to FFT (Fast Fourier Transform) units 13 and 14. For reference's sake, the data count at this time becomes M/2.

By performing a complex fast Fourier transform (complex FFT) processing while taking a phase into account, the FFT units 13 and 14 respectively transforms the data Xref(m) of the pristine state transfer characteristic T and the data X(m) of the head related transfer function H from the time-axis data into the frequency-axis data.

To be more specific, through the complex FFT processing, the FFT unit 13 transforms the data Xref(m) of the pristine state transfer characteristic T into FFT data composed of a real part Rref(m) and an imaginary part jIref(m), that is, Rref(m)+jIref(m) and supplies this to a polar coordinate transform unit 15.

Also, through the complex FFT processing, the FFT unit 14 transforms the data X(m) of the head related transfer function into FFT data composed of a real part R(m) and an imaginary part jI(m), that is, R(m)+jI(m) and supplies this to a polar coordinate transform unit 16.

Figure 5A:
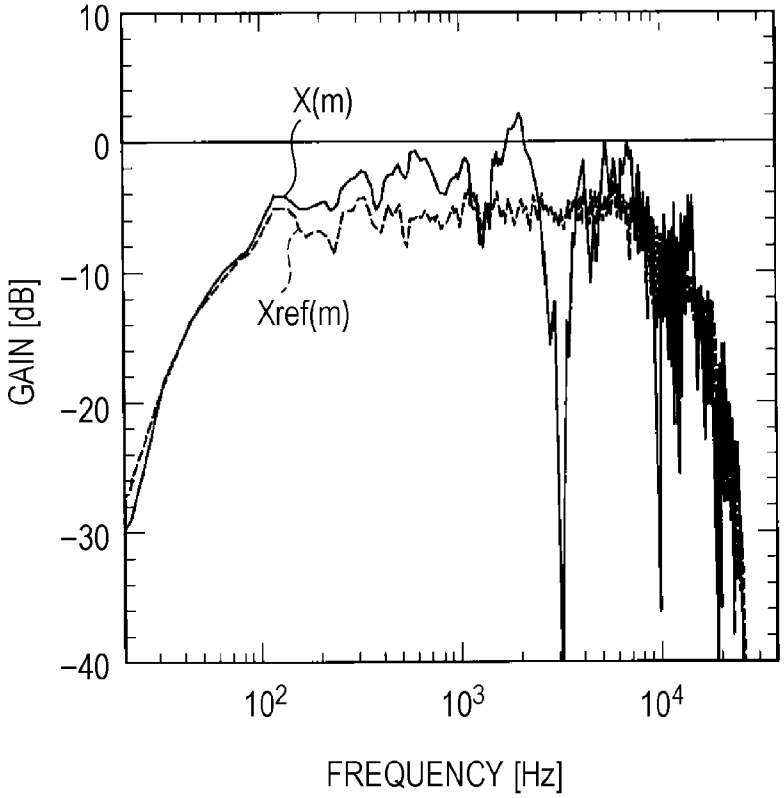
FIGS. 5A and 5B are outlined diagrams illustrating frequency characteristics of the head related transfer function before and after a measurement normalization processing.

The FFT data obtained by the FFT units 13 and 14 becomes X-Y coordinate data representing the frequency characteristics. Herein, when the pieces of FFT data of both the pristine state transfer characteristic T and the head related transfer function H are overlapped with each other, as illustrated in FIG. 5A, it is understood that although the pieces of FFT data are approximate to each other and have a high correlativity as an overall tendency, different parts are occasionally found, and a unique peak appeared only in the head related transfer function H.

For reference's sake, the correlativity of those characteristics is relatively high because it is conceivable that the states where the head related transfer function H and the pristine state transfer characteristic T are respectively measured (that is, indoor acoustic characteristics) are similar to each other as a whole while the presence or absence of the dummy head DH is only the difference point. Also, the data count at this time becomes M/4.

The polar coordinate transform units 15 and 16 respectively transform these pieces of FFT data into X-Y coordinate data (orthogonal coordinate data) into polar coordinate data.

To be more specific, the polar coordinate transform unit 15 transforms the FFT data Rref(m)+jIref(m) of the pristine state transfer characteristic T into a radius vector γref(m) that is a magnitude component and a deflection angle θref(m) that is an angle component. Then, the polar coordinate transform unit 15 supplies the radius vector γref(m) and the deflection angle θref(m), that is, the polar coordinate data to a normalization processing unit 20.

Also, the polar coordinate transform unit 16 transforms the FFT data R(m)+jI(m) of the head related transfer function H into a radius vector γ(m) and a deflection angle θ(m). Then, the polar coordinate transform unit 16 supplies the radius vector γ(m) and the deflection angle θ(m), that is, the polar coordinate data to the normalization processing unit 20.

The normalization processing unit 20 normalizes the head related transfer function H measured in the state in which the dummy head DH exists by the pristine state transfer characteristic T where the dummy head DH or the like does not exist.

To be more specific, with regard to the normalization and the normalization processing unit 20, by performing the normalization processing while following Expression (1) and Expression (2) below, a radius vector γn(m) and a deflection angle θn(m) after the normalization are respectively calculated to be supplied to an X-Y coordinate transform unit 21.

$$\gamma n(m) = \frac{\gamma(m)}{\gamma ref(m)} \quad (1)$$

$$\theta n(m) = \theta(m) - \theta ref(m) \quad (2)$$

That is, in the normalization processing unit 20, with regard to the size component, the radius vector γ(m) is divided by the radius vector γref(m), and also with regard to the angle component, the deflection angle θref(m) is subtracted from the deflection angle θ(m), so that the normalization processing is set to be carried out with regard to the data of the polar coordinate system.

The X-Y coordinate transform unit 21 transforms the data of the polar coordinate system after the normalization processing into data of the X-Y coordinate system (orthogonal coordinate system).

To be more specific, the X-Y coordinate transform unit 21 transforms the radius vector γn(m) and the deflection angle θn(m) of the polar coordinate system into frequency-axis data composed of a real part Rn(m) and an imaginary part jIn(m) of the X-Y coordinate system (where m=0, 1, . . . , M/4-1) to be supplied to an inverse FFT unit 22.

Figure 5B:
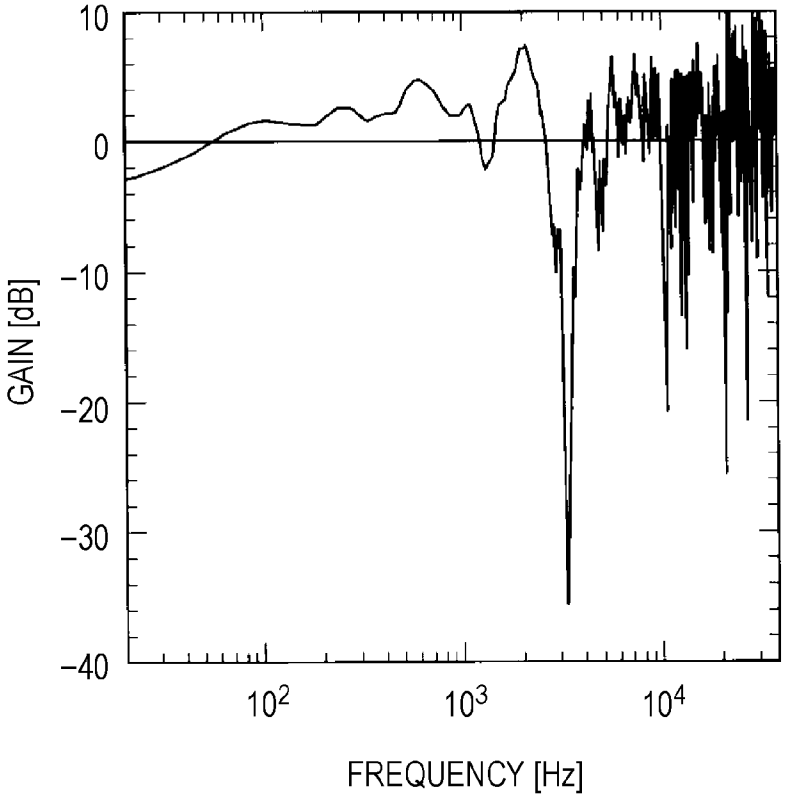

For reference's sake, the frequency-axis data after the transform has, for example, a frequency characteristic illustrated in FIG. 5B and represents the normalized head related transfer function HN.

As understood from FIG. 5B, the normalized head related transfer function HN has a frequency characteristic in which a low-frequency area and a high frequency area having a low gain are lifted in both the head related transfer function H before the normalization and the pristine state transfer characteristic T.

Also, as seen from another viewpoint, the normalized head related transfer function HN is roughly equivalent to a difference between the head related transfer function H and the pristine state transfer characteristic T and has a characteristic in which the gain fluctuates into negative and positive in accordance with a frequency change while 0 [dB] is set as the center.

The inverse FFT (IFFT: Inverse Fast Fourier Transform) unit 22 transforms the normalized head related transfer function data that is the frequency-axis data of the X-Y coordinate system into the normalized head related transfer function data on the time axis into an impulse response Xn(m) through the complex inverse fast Fourier transform (complex inverse FFT) processing.

To be more specific, by performing a computation processing that follows Expression (3) below, the inverse FFT unit 22 generates the impulse response Xn(m) that is the normalized head related transfer function data on the time axis and supplies this to an IR (impulse response) simplification unit 23.

$$Xn(m) = IFFT(Rn(m) + jIn(m)) \quad (3)$$

Where $$m = 0, 1, 2, \ldots, \frac{M}{2} - 1$$

The IR simplification unit 23 simplifies the impulse response Xn(m) into a tap length of the processable impulse characteristic, that is, a tap length of the impulse characteristic where the convolution processing can be performed which will be described below, to obtain the normalized head related transfer function HN.

To be more specific, the IR simplification unit 23 simplifies the impulse response Xn(m) into 80 taps, that is, the impulse response Xn(m) (m=0, 1, . . . , 79) composed of 80 pieces of data from the leading of data sequence and stores this in a predetermined storage unit.

As a result, when the speaker SP is installed at the predetermined assumed sound source direction position (FIGS. 2A and 2B) while the listening position of the listener or the measurement point position is set as the base point, the normalization processing circuit 10 can generate the normalized head related transfer function HN of the main component with respect to the relevant assumed sound source direction position.

The thus generated normalized head related transfer function HN becomes a function from which the influences by the characteristics of the microphones ML and MR and the speaker SP used for the measurement are eliminated.

For this reason, the normalization processing circuit 10 can eliminate the influences by the characteristics of the microphones ML and MR and the speaker SP used for the measurement without purposely using expensive microphones, speaker, or the like having an excellent characteristic where the frequency characteristic is flat, for example, in the head related transfer function measurement system 1.

For reference's sake, the normalization processing circuit 10 generates the normalized head related transfer function HN of the cross talk component with respect to the assumed sound source direction position by performing a similar computation processing also with regard to the cross talk component and stores this in a predetermined storage unit.

It should be noted that the respective signal processings in the normalization processing circuit 10 can be performed mainly by a DSP (Digital Signal Processor). In this case, each of the delay removal units 11 and 12, the FFT units 13 and 14, the polar coordinate transform units 15 and 16, the normalization processing unit 20, the X-Y coordinate transform unit 21, the inverse FFT unit 22, and the IR simplification unit 23 may be composed of the DSP or may also be collected as a whole to be constituted by one or a plurality of DSPs.

In this manner, the normalization processing circuit 10 is adapted to normalize the head related transfer function H by the pristine state transfer characteristic T (hereinafter, which will be referred to as measurement normalization processing) and generate the normalized head related transfer function HN from which the influences of the devices for the measurement such as the microphones ML and MR and the speaker SP are eliminated.

1-3. Power Voltage Transform Processing

Incidentally, in the head related transfer function measurement system 1 (FIGS. 2A and 2B), when the head related transfer function H or the like is measured, as described above, a sound signal composed of an impulse such as TSP (Time Stretched Pulse) (hereinafter, which will be referred to as supplied sound signal) is supplied to the speaker SP and output as a sound.

Along with this, in the head related transfer function measurement system 1, for example, the sound is picked up by the microphone ML, and a sound signal (hereinafter, which will be referred to as measured sound signal) is generated. This measured sound signal represents the impulse response.

Herein, the measured sound signal is equivalent to a measurement result at a time when a sound pressure characteristic of the speaker SP is measured, and, for example, a distance from the speaker SP to the microphone ML is set to be doubled, the sound pressure level is decreased by 6 [dB].

In general, the sound pressure characteristic is in energy representation, and the decrease in the sound pressure level by 6 [dB] means that the sound pressure becomes ×¼ (×½²). This means that the impulse response obtained through the real measurement is represented by the dimension of the sound pressure, that is, the dimension of energy or power.

In this manner, in the head related transfer function measurement system 1, whereas the supplied sound signal supplied to the speaker SP is in the dimension of the voltage, the measured sound signal obtained by the microphone ML is in the dimension of the power.

Herein, representation of a relation between the supplied sound signal and the measured sound signal through a numerical expression will be discussed. For example, while it is assumed that the frequency characteristics of the speaker SP and the microphone ML are basically flat, the voltage of the supplied sound signal is set as Xi [V], and the voltage of the measured sound signal is set as Xo [V].

An output sound pressure Pi from the speaker SP at the time of the measurement of the head related transfer function can be represented by the following Expression (4) when an efficiency of the speaker SP is set as Gs and an impedance is set as Z[Ω].

$$Pi = Gs \times \frac{Xi^2}{Z} \tag{4}$$

Also, the voltage Xo of the measured sound signal can be represented by the following Expression (5) while utilizing the relation of Expression (4) when a sensitive of the microphone ML is set as Gm.

$$\begin{aligned} Xo &= Gm \times Pi \\ &= Gs \times Gm \times \frac{Xi^2}{Z} \end{aligned} \tag{5}$$

From this Expression (5), it is understood that the voltage Xo of the measured sound signal has a relation in proportion to squares of the voltage Xi of the supplied sound signal.

For this reason, for example, in a case where the head related transfer function is generated to be convolved to the sound signal on the basis of the impulse response in the dimension of the power obtained as the measured sound signal, a rather emphasized sound signal is obtained as compared with the case in which the head related transfer function based on the correct impulse response (in the dimension of the voltage) is convolved.

In view of the above, transform of the measured sound signal represented in the dimension of the power into the dimension of the voltage will be discussed. In general, in a case where the measured sound signal is transformed from the dimension of the power into the dimension of the voltage, a square root may be calculated in general, but in actuality, the following two points will become major problems.

The first problem is that if the impulse response picked up by the microphone ML includes a reflected sound, a reverberant sound, or the like, this becomes a quadratic polynomial with regard to the voltage Xi of the supplied sound signal on the numerical expression, and it is difficult to solve the voltage Xi of the supplied sound signal.

For example, a direct wave, a first-order reflected wave, a second-order reflected wave, . . . , an n-th order reflected wave are respectively set as X0, X1(a), X2(b), . . . , Xn(m), and the first-order and subsequent reflectivity coefficients are respectively set as ϵ(a), ϵ(b), . . . , ϵ(n). Also, the first-order and subsequent relative space attenuation coefficients with respect to the energy of the sound signal output from the speaker SP are respectively set as δ(a), δ(b), . . . , δ(n).

The direct wave X0 can be represented by the following Expression (6), and the first-order reflected wave X1(a), the second-order reflected wave X2(b), . . . , the n-th order reflected wave Xn(m) can be respectively represented by the following Expression (7).

$$X0 = \alpha \times \frac{(Xi)^2}{Z} \tag{6}$$

$$\begin{aligned} X1(a) &= \sum \gamma(a) \times \delta(a) \times \alpha \times \frac{(Xi)^2}{Z} \\ X2(b) &= \sum \gamma(b) \times \delta(b) \times X1(a) \\ &\vdots \\ Xn(m) &= \sum \gamma(n) \times \delta(n) \times X(n-1)(m-1) \end{aligned} \tag{7}$$

Also, the voltage Xo of the measured sound signal can be represented by the following Expression (8).

$$Xo = X0 + X1(a) + X2(b) + \ldots + Xn(m) + \ldots \tag{8}$$

That is, as understood from Expressions (6) to (8), the calculation of only the square root with regard to the voltage Xo of the measured sound signal does not lead to a direct function with regard to the voltage Xi of the supplied sound signal, and a complex computation processing such as solution of a quadratic equation should be carried out.

The second problem is that even if only the signal component of the direct wave can be separated, the measured sound signal is merely a relative value, and due to the influence by the reflected wave, the reverberant sound, or the like, it is difficult to clearly define a signal level serving as a unity gain of the input and output, that is, a reference point where the square root becomes 1.

Therefore, the simple calculation of the square root with regard to the voltage Xo of the measured sound signal does not disclose a relation with the voltage Xi of the supplied sound signal.

On the other hand, according to the disclosure of the present application, these problems can be solved as follows.

Regarding the first problem, in the head related transfer function measurement system 1 according to the disclosure of the present application, as described above, a reflected wave (so-called reverberant sound) due to the existence of a wall or the like is not generated in the anechoic chamber 2, and only the direct wave is picked up. That is, in the head related transfer function measurement system 1, it is possible to independently obtain only the direct wave X0 in Expression (6) where the respective terms in Expression (7) are all eliminated.

With this configuration, in the head related transfer function measurement system 1, as a right side in Expression (8) has only the first term, by only calculating the square roots of both the sides, this can be represented as a numerical expression with regard to the voltage Xi of the supplied sound signal.

Also, regarding the second problem, in the normalization processing circuit 10 (FIG. 4) according to the disclosure of the present application, as described above, in the normalization processing, the radius vector γ(m) of the head related transfer function H is divided by the radius vector γref(m) of the pristine state transfer characteristic T while following Expression (1).

This division also functions as relativization of the gain in the head related transfer function. For this reason, as illustrated in FIG. 5B, for the radius vector γn(m) after the normalization processing, the signal level where 0 [dB] is set is decided, and along with this, the reference point where the square root becomes 1 is also clarified.

In keeping with these, according to the disclosure of the present application, the square root is set to be calculated with regard to the radius vector γn(m) after the normalization processing. This is equivalent to a case in which the square roots of both the sides in Expression (6) are calculated to clear up with regard to the voltage Xi of the supplied sound signal, and the impulse response is set to be transformed from the dimension of the power into the dimension of the voltage. Hereinafter, the processing for calculating the square root with regard to the radius vector γn(m) after the normalization processing in this manner will be referred to as dimension transform processing.

Figure 6:
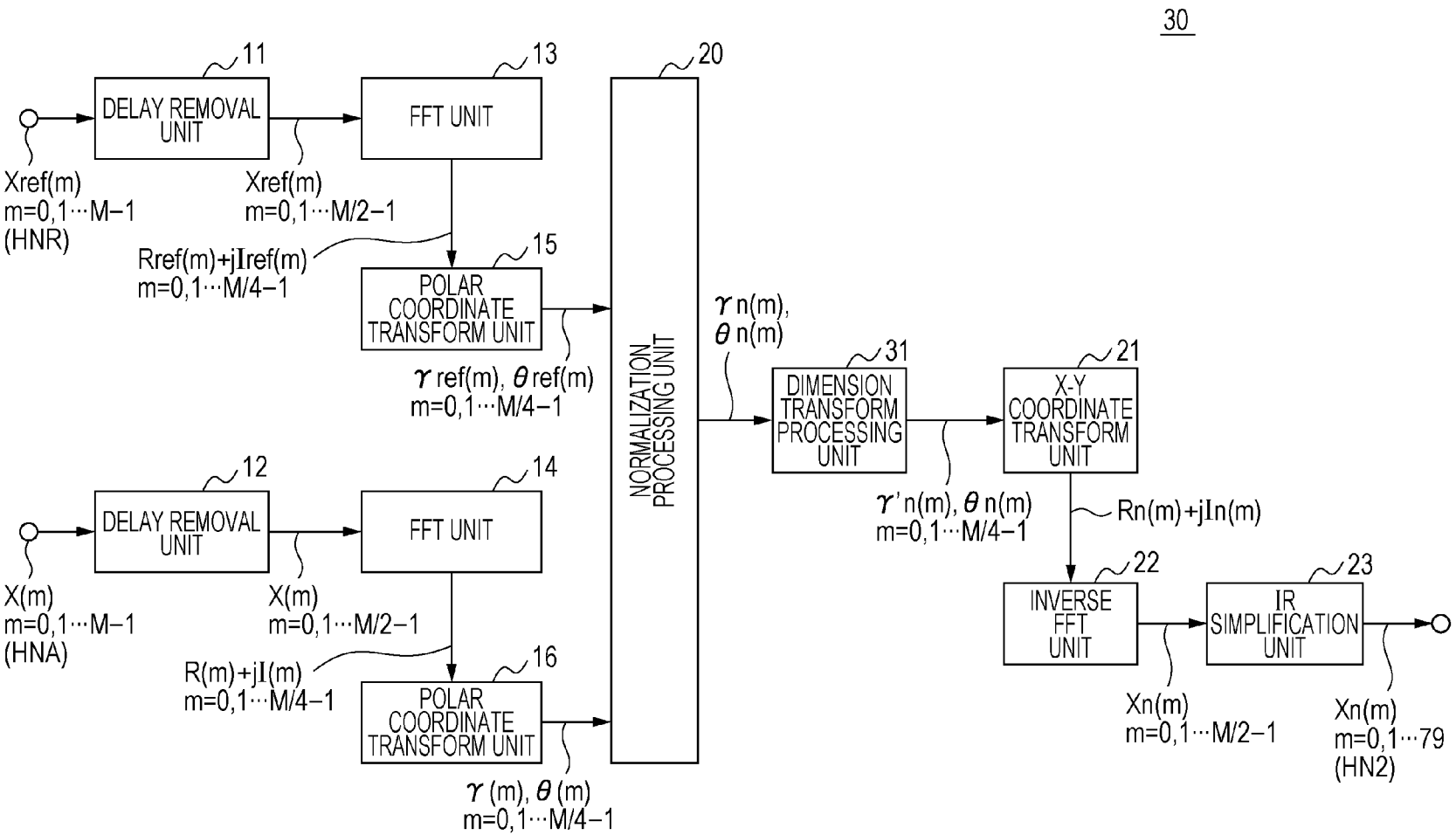
FIG. 6 is an outlined block diagram illustrating a configuration of a dimension transform normalization processing circuit.

To be more specific, according to the present disclosure, when the head related transfer function is generated, the normalization processing and the dimension transform processing are performed by a dimension transform normalization processing circuit 30 illustrated in FIG. 6 instead of the normalization processing circuit 10.

The dimension transform normalization processing circuit 30 has a configuration similar to the normalization processing circuit 10 as a whole but is different therefrom in that a dimension transform processing unit 31 is provided between the normalization processing unit 20 and the X-Y coordinate transform unit 21.

The dimension transform processing unit 31 is adapted to calculate a square root of the radius vector γn(m) after the normalization processing calculated by the normalization processing unit 20. To be more specific, the dimension transform processing unit 31 performs the transform into a radius vector γ'n(m) while following Expression (9) below.

$$\gamma' n(m) = \sqrt{\gamma n(m)} \tag{9}$$

After that, the dimension transform processing unit 31 supplies the calculated radius vector γ'n(m) and the supplied deflection angle θn(m) as it is to the X-Y coordinate transform unit 21.

The X-Y coordinate transform unit 21 is adapted to transform the radius vector γ'n(m) and the deflection angle θn(m) into data of the X-Y coordinate system (orthogonal coordinate system) similarly as in the case where the radius vector γn(m) after the normalization processing and the deflection angle θn(m) are supplied in the normalization processing circuit 10.

Figure 7A:
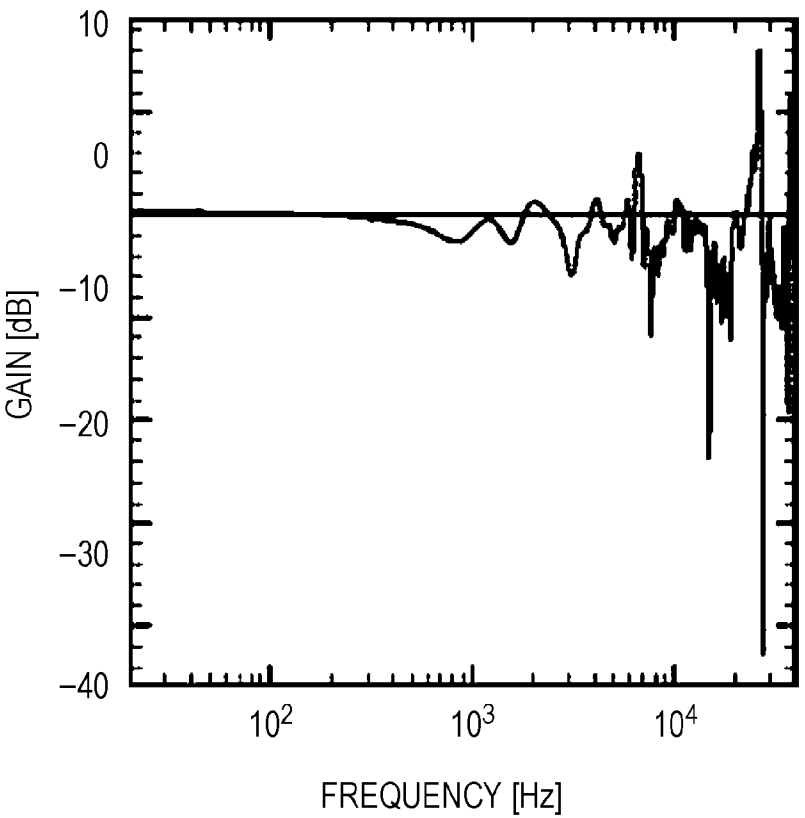
FIGS. 7A and 7B are outlined diagrams illustrating frequency characteristics of an impulse response.
Figure 7B:
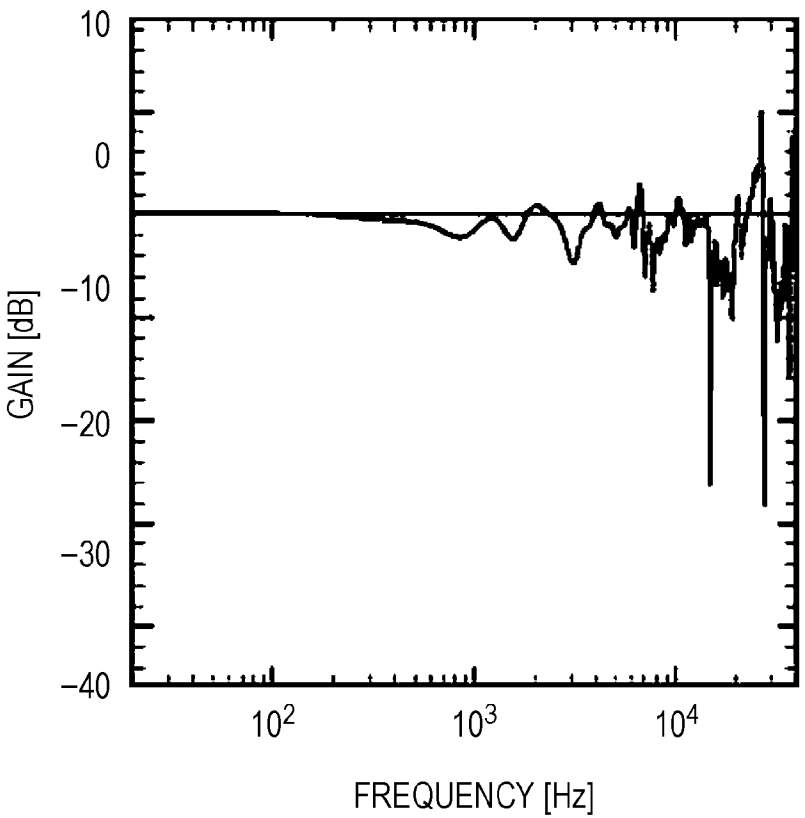

Herein, the frequency characteristics of the impulse responses before and after the dimension transform processing have waveforms respectively illustrated in FIGS. 7A and 7B.

In FIG. 7B, it is understood that although the characteristic has a large number of peaks like FIG. 7A, the respective peak levels are decreased, that is, the respective peaks approach 0 [dB].

Figure 8A:
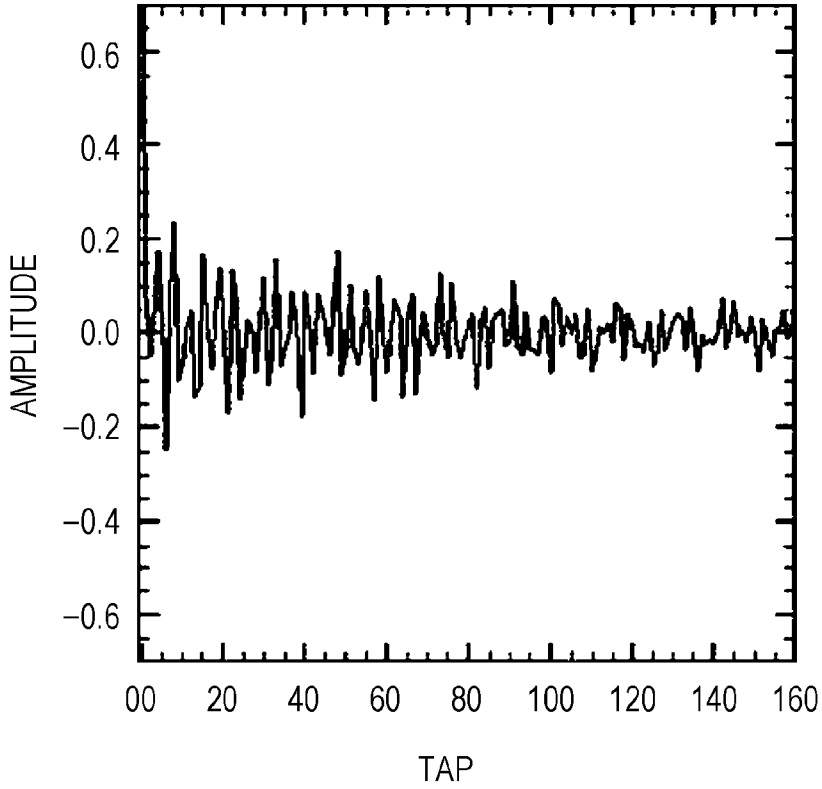
FIGS. 8A and 8B are outlined diagrams illustrating waveforms of the impulse response.
Figure 8B:
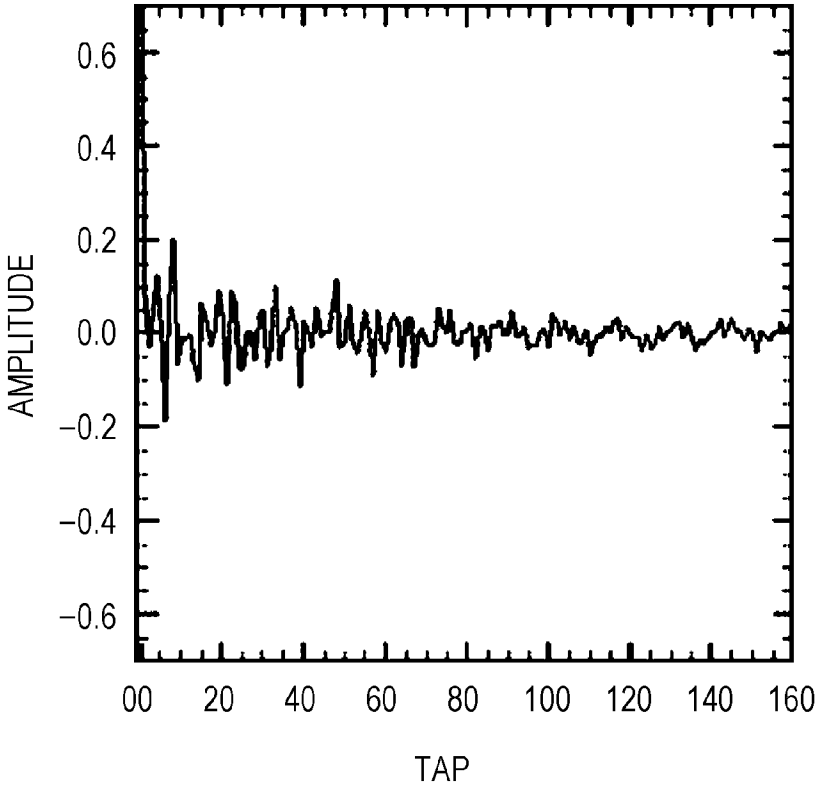

Also, when the impulse responses before and after the dimension transform processing are represented as the time-axis data, waveforms respectively illustrated in FIGS. 8A and 8B are obtained.

In FIG. 8B, it is understood that the characteristic has a large number of peaks gradually attenuating like FIG. 8A, but the respective amplitudes are reduced.

In this manner, according to the disclosure of the present application, by applying the normalization processing and the dimension transform processing on the head related transfer function obtained in the anechoic chamber 2 through the measurement of only the direct wave, the appropriate normalized head related transfer function transformed from the dimension of the power into the dimension of the voltage is set to be generated.

2. First Embodiment

Next, as a first embodiment based on the above-mentioned basic principle, a television apparatus 50 will be described.

2-1. Configuration of Television Apparatus

Figure 9A:
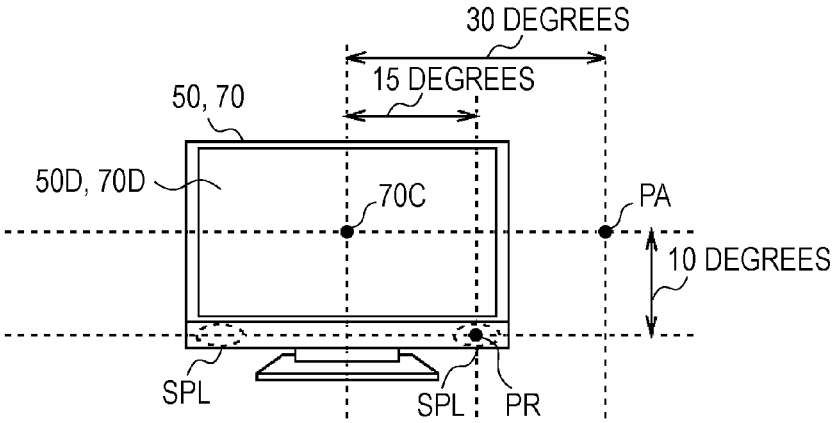
FIGS. 9A, 9B, and 9C are outlined diagrams used for describing a real sound source direction position and an assumed sound source direction position.

As illustrated in FIG. 9A, in the television apparatus 50, the left and speakers SPL and SPR are mounted at positions below a display panel 50D, and sound is set to be output from the speakers SPL and SPR. Also, the television apparatus 50 is installed in front of the listener at a distance by a predetermined interval.

The television apparatus 50 is adapted to output the head related transfer function on which the normalization processing and the dimension transform processing described above are applied from the speakers SPL and SPR while being convolved to the sound signal that should be output.

Figure 10:
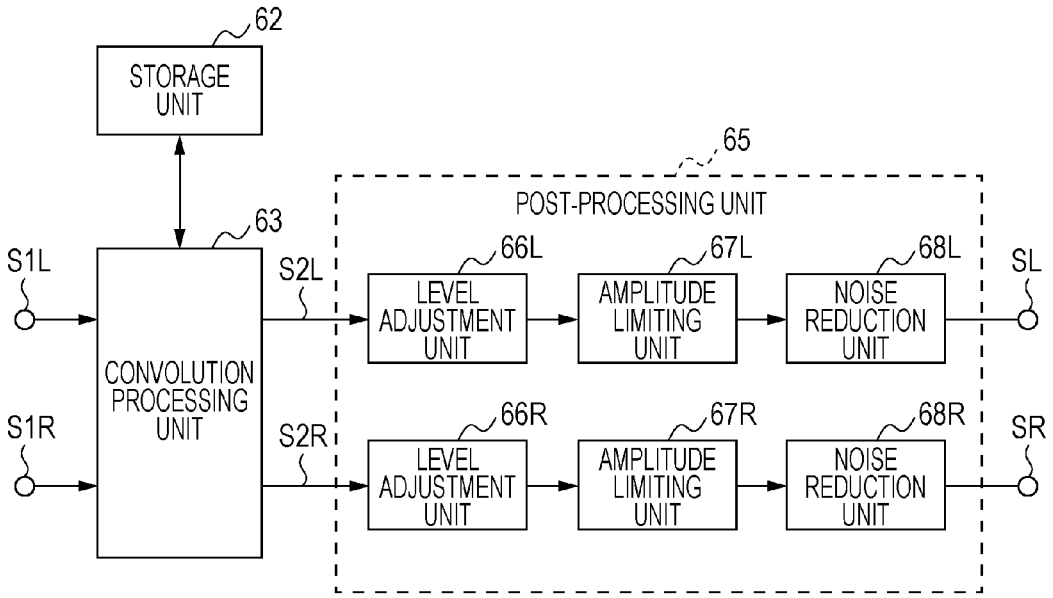
FIG. 10 is an outlined block diagram illustrating a configuration of a sound signal processing unit according to a first embodiment.

At this time, the television apparatus 50 is adapted to apply the convolution processing of the head related transfer function on the left and right two-channel sound signals by a sound signal processing unit 60 illustrated in FIG. 10 and supply these to the speakers SPL and SPR via a predetermined amplifier (not illustrated in the drawing).

The sound signal processing unit 60 has a non-volatile storage unit 62 that stores the head related transfer function, a convolution processing unit 63 that convolves the head related transfer function into the sound signal, and a post-processing unit 65 that applies a predetermined post-processing on the sound signal.

The storage unit 62 stores the normalized head related transfer function HN that is generated by the dimension transform normalization processing circuit 30 (FIG. 6) on the basis of the head related transfer function H measured by the head related transfer function measurement system 1 (FIGS. 2A and 2B) with regard to the speaker SPR on the right side in the television apparatus 50 and the pristine state transfer characteristic T.

For reference's sake, as the install position for the speaker SPL on the left side is bilaterally-symmetric to the speaker SPL, the normalized head related transfer function HN with regard to the speaker SPR on the right side is set to be utilized.

The convolution processing unit 63 reads out the normalized head related transfer function HN stored in the storage unit 62, performs the convolution processing on the normalized head related transfer function HN to be convolved to each of left and right sound signals S1L and S1R, and supplies the thus generated sound signals S3L and S3R to the post-processing unit 65.

At this time, the convolution processing unit 63 can eliminate the influences of the speaker and the microphone at the time of the measurement of the head related transfer function and also apply the appropriate normalized head related transfer function transformed from the dimension of the power into the dimension of the voltage to the respective sound signals S1L and S1R.

The post-processing unit 65 is constructed by level adjustment units 66L and 66R that perform a level adjustment on the sound signals, amplitude limiting units 67L and 67R that limit the amplitudes of the sound signals, and noise reduction units 68L and 68R that reduce noise components of the sound signals.

First, the post-processing unit 65 supplies the sound signals S3L and S3R supplied from the convolution processing unit 63 to the level adjustment units 66L and 66R, respectively.

The level adjustment units 66L and 66R generate sound signals S4L and S4R by adjusting the sound signals S3L and S3R to a level suitable to the outputs from the respective speakers SPL and SPR and supply the sound signals S4L and S4R to the amplitude limiting units 67L and 67R, respectively.

The amplitude limiting units 67L and 67R generate sound signals S5L and S5R by performing a processing of limiting the amplitudes with regard to the sound signals S4L and S4R and supply the sound signals S5L and S5R to the noise reduction units 68L and 68R, respectively.

The noise reduction units 68L and 68R generate sound signals S6L and S6R by performing a processing of reducing the noise with regard to the sound signals S5L and S5R and supply the sound signals S6L and S6R to the speakers SPL and SPR (FIG. 9A) via an amplifier that is not illustrated in the drawing.

In accordance with this, the television apparatus 50 outputs the sounds based on the sound signals S6L and S6R from the left and right speakers SPL and SPR. As a result, the television apparatus 50 can allow the listener to listen to the sound with a satisfactory sound quality where the influences by the characteristics of the speakers SPL and SPR themselves are reduced.

2-2. Operations and Effects

In the above-mentioned configuration, according to the first embodiment, first, the head related transfer function H and the pristine state transfer characteristic T are generated by the head related transfer function measurement system 1 (FIGS. 2A and 2B) on the basis of the impulse response of the direct wave in the anechoic chamber 2 with regard to the speaker SPL of the television apparatus 50.

Next, the normalized head related transfer function HN is generated by the dimension transform normalization processing circuit 30 (FIG. 6), and this is previously stored in the storage unit 62 of the sound signal processing unit 60 in the television apparatus 50.

At this time, through an extremely simple computation processing of calculating a square root of the radius vector $\gamma n(m)$ by the dimension transform processing unit 31 and generating the radius vector $\gamma' n(m)$ to be supplied to a latter stage, the dimension transform normalization processing circuit 30 can generate the normalized head related transfer function HN that is correctly transformed from the dimension of the power into the dimension of the voltage.

Then, the television apparatus 50 reads out the normalized head related transfer function HN from the storage unit 62, convolves the normalized head related transfer function HN respectively into the sound signals S1L and S1R by the convolution processing unit 63 to generate the sound signals S3L and S3R, and outputs the sounds based on these from the speakers SPL and SPR.

As a result, as the appropriate normalized head related transfer function HN transformed into the dimension of the voltage can be convolved to each of the sound signals S1L and S1R, the television apparatus 50 can allow the listener to listen to the natural, high-quality sound without too much emphasis involved therein.

At this time, as the measurement normalization processing is carried out, the television apparatus 50 can appropriately eliminate the influences of the speaker and the microphone used for the measurement of the head related transfer function.

According to the above-mentioned configuration, on the basis of the head related transfer function H with regard to the direct wave and the pristine state transfer characteristic T, the television apparatus 50 according to the first embodiment convolves the normalized head related transfer function HN generated through the measurement normalization processing and the dimension transform processing into the respective sound signals respectively and outputs the sounds from the respective speakers. With this configuration, as that the normalized head related transfer function HN is measured in the dimension of the power and correctly transformed into the dimension of the voltage can be convolved to the respective sound signals, the television apparatus 50 can allow the listener to listen to the natural, high-quality sound without too much emphasis involved therein.

3. Second Embodiment

Next, a television apparatus 70 according to a second embodiment will be described.

3-1. Principles of Sound Image Localization and Double Normalization Processing

In the television apparatus 70, similarly as in the television apparatus 50 (FIG. 9A), the left and right speakers SPL and SPR are mounted at positions below a display panel 70D.

Figure 9B:
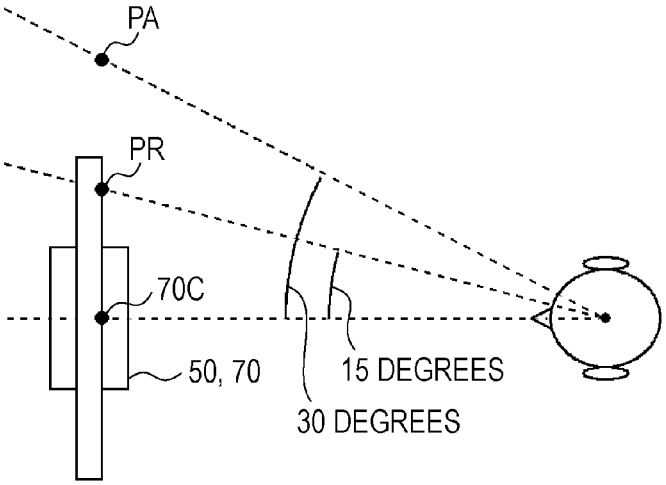
Figure 9C:
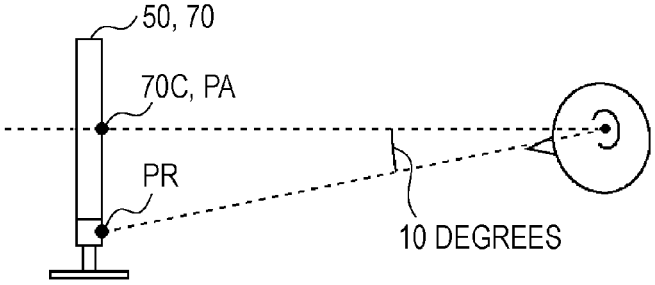

Herein, when an attention is paid to the speaker SPR on the right side, as illustrated in FIGS. 9B and 9C, the speaker SPR is mounted at a position at 15 degrees in the right direction and at 10 degrees in the downward direction with respect to a substantially center position of the display panel 70D while the listener is set as the base point (hereinafter, which will be referred to as display center 70C). Hereinafter, a position where the sound source (the speakers SPL and SPR or the like) is installed in reality in this manner is referred to as real sound source direction position PR.

For this reason, in the television apparatus 70, in a case where each of the sounds is reproduced from the speakers SPL and SPR as it is, such a sound image is set to be formed that the sounds in all the channels are output from a lower side of the center position of the display panel 70D.

In view of the above, in the television apparatus 70, through the normalization processing using the head related transfer function, the sound images in the respective channels are localized at desired positions. Herein, a principle of the virtual sound image localization using the head related transfer function will be described.

At this time, the desired position where the sound image of the sound output from the speaker SPR on the right side in the television apparatus 70 is desired to be localized (hereinafter, which will be referred to as assumed sound source direction position PA) is set as a position that is inclined at 30 degrees in the right direction with respect to the display center 70C while the listener is set as the base point and is at an equivalent height in terms of up and down direction.

In general, the head related transfer function varies in accordance with the direction and the position of the sound source when the position of the listener is set as the reference.

That is, by convolving the head related transfer function H with regard to the desired position where the sound image is desired to be localized (the assumed sound source direction position PA) (hereinafter, which will be referred to as assumed direction head related transfer function HA) into the sound signal, it is possible to localize the sound image at the assumed sound source direction position PA for the listener who listens to the sound based on the sound signal.

Incidentally, when the listener actually listens to the sound output from the sound source, the listener listens to the sound in accordance with the direction and the position of the real sound source while the position of the listener is set as the reference, that is, such a sound that the head related transfer function H (hereinafter, which will be referred to as real direction head related transfer function HR) at the real sound source direction position PR is convolved.

For this reason, when the assumed direction head related transfer function HA is only simply convolved to the sound signal, the influence by the real direction head related transfer function HR related to the position where the sound source is installed remains, and therefore the sound image localization may not be carried out appropriately at the desired position, which also may lead to a degradation in sound quality.

In view of the above, according to the second embodiment, by normalizing the assumed direction head related transfer function HA with the real direction head related transfer function HR (hereinafter, which will be referred to as localization normalization), the normalized head related transfer function HN from which the influence by the real sound source direction position PR is eliminated is set to be generated.

As a specific computation processing, similarly as in the case of the measurement normalization where the influences of the devices for the measurement such as the microphone and the speaker are eliminated, it is possible to carry out the normalization processing by the normalization processing circuit 10 (FIG. 4).

In this case, the delay removal unit 11 of the normalization processing circuit 10 obtains data representing the real direction head related transfer function HR of only the direct wave in the real sound source direction position PR from the sound signal processing unit 3 of the head related transfer function measurement system 1 (FIGS. 2A and 2B).

Also, the delay removal unit 11 obtains data representing the assumed direction head related transfer function HA of only the direct wave at the assumed sound source direction position PA from the sound signal processing unit 3 in the head related transfer function measurement system 1.

After that, by performing a computation processing similar to that in a case where the first normalization processing is carried out, the normalization processing circuit 10 generates the normalized head related transfer function HN obtained by normalizing the assumed direction head related transfer function HA with the real sound source direction position PR and stores this in a normalized head related transfer function storage unit.

In this manner, in a case where the assumed direction head related transfer function HA is normalized with the real direction head related transfer function HR (hereinafter, which will be referred to as localization normalization processing), the normalization processing circuit 10 can generate the normalized head related transfer function HN from which the influence by the real sound source direction position PR is eliminated.

Furthermore, in the normalization processing circuit 10, by previously normalizing each of the assumed direction head related transfer function HA and the real direction head related transfer function HR, it is also possible to generate a double normalized head related transfer function HN2 on which the double normalization processing by the measurement normalization processing and the localization normalization processing are applied.

Figure 11:
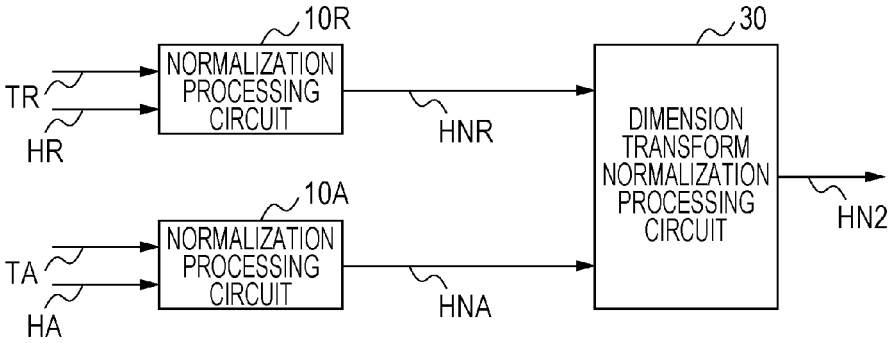
FIG. 11 is an outlined block diagram illustrating an overview of a double normalization processing.

According to the second embodiment, as the overview is illustrated in FIG. 11, as the double normalization processing based on such a principle, in the wake of the normalization processing in the first stage by normalization processing circuits 10R and 10A having a configuration similar to the normalization processing circuit 10, the normalization processing in the second stage by the dimension transform normalization processing circuit 30 is set to be carried out.

Figure 12B:
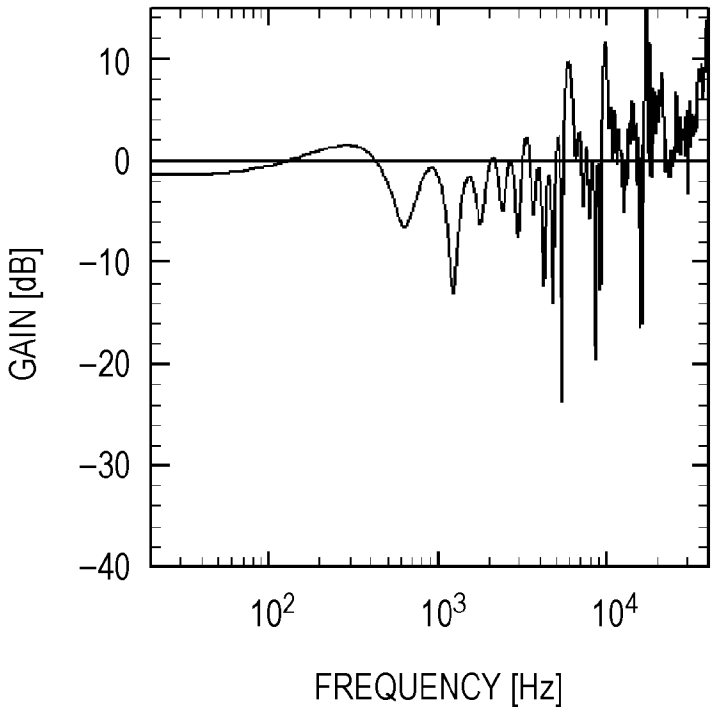
FIGS. 12A and 12B are outlined diagrams illustrating frequency characteristics of the head related transfer function before and after a localization normalization processing.
Figure 12A:
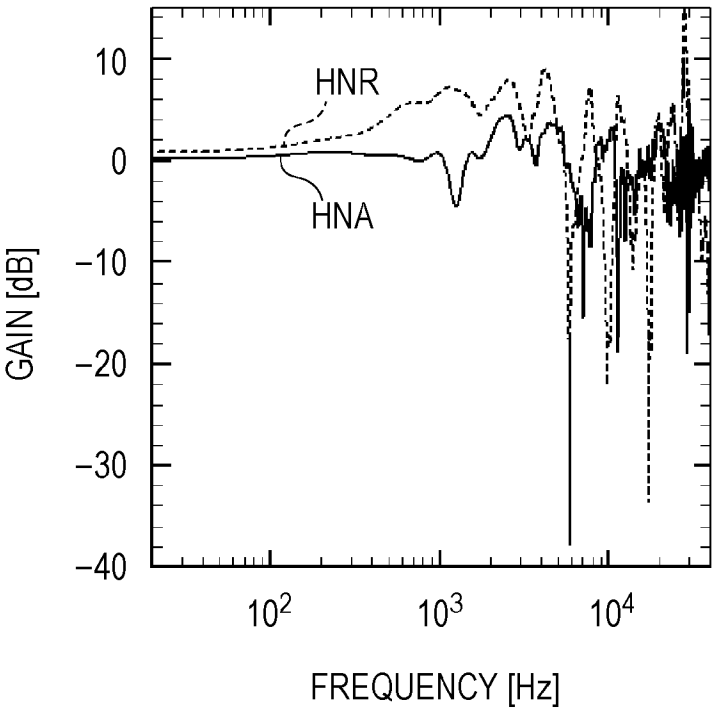

The normalization processing circuit 10R performs the measurement normalization on the head related transfer function HR with a pristine state transfer function TR with regard to the real sound source direction position PR to generate a real direction normalized head related transfer function HNR. For reference's sake, the real direction normalized head related transfer function HNR has, for example, a frequency characteristic represented by a broken line in FIG. 12A.

The normalization processing circuit 10A performs the measurement normalization on the head related transfer function HA with a pristine state transfer function TA with regard to the assumed sound source direction position PA to generate an assumed direction normalized head related transfer function HNA. For reference's sake, the assumed direction normalized head related transfer function HNA has, for example, a frequency characteristic represented by a real line in FIG. 12A.

The dimension transform normalization processing circuit 30 performs the localization normalization on the assumed direction normalized head related transfer function HNA with the real direction normalized head related transfer function HNR as the normalization processing in the second stage and further applies the dimension transform processing to generate the double normalized head related transfer function HN2. For reference's sake, the double normalized head related transfer function HN2 immediately after the localization normalization processing is applied (that is, before the dimension transform processing is applied) has, for example, a frequency characteristic illustrated in FIG. 12B.

While following the above-mentioned principle, in the television apparatus 70, the double normalization processing composed of the measurement normalization processing and the localization normalization processing is carried out, and also the dimension transform processing is carried out to generate the double normalized head related transfer function HN2, and then the sound image localization processing is carried out.

3-2. Reproduction of Multi-Surround Sound

Incidentally, with regard to a content in which a video is displayed and also a sound is output by the television apparatus 70, a content supplied as multi-surround such as 5.1 channels or 7.1 channels exists apart from 2 channels.

Figure 13A:
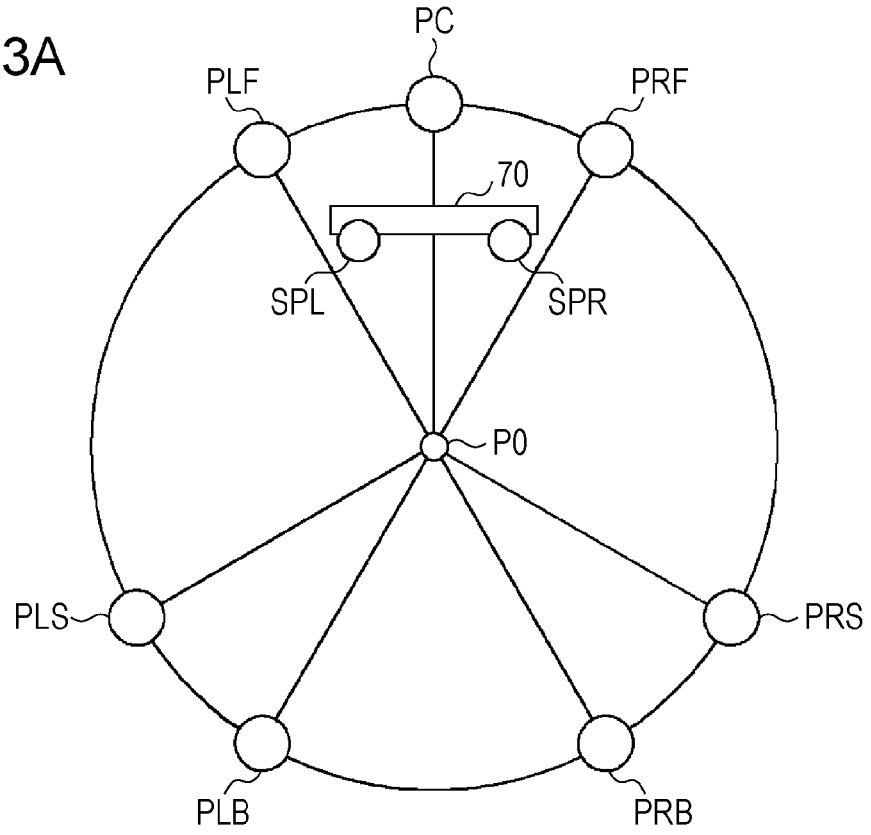
FIGS. 13A and 13B are outlined diagrams illustrating speaker arrangement examples (1) in 7.1-channel multi-surround.

For example, FIG. 13A illustrates a speaker arrangement example in the case of the 7.1-channel multi-surround based on ITU-R (International Telecommunication Union-Radio communication Sector).

In the arrangement example of the ITU-R 7.1-channel multi-surround speaker, it is designed that speakers in the respective channels are positioned on a circumference of a circle where the position P0 of the listener is set as the center, and sounds based on sound signals in the respective channels are output from the respective speakers.

In FIG. 13A, a speaker position PC of the center channel is a position in front of the listener. Also, a speaker position PLF in the left front channel and a speaker position PRF in the right front channel become positions away by an angular range at 30 degrees respectively on both sides while the speaker position PC of the center channel is set as the center.

A speaker position PLS on the left side channel and a speaker position PLB on the left back channel are respectively arranged in a range from 120 degrees to 150 degrees towards left from the front position of the listener. Also, a speaker position PRS in the tight side channel and a speaker position PRB in the right back channel are respectively arranged in a range from 120 degrees to 150 degrees towards right from the front position of the listener. For reference's sake, these speaker positions PLS and PLB and speaker positions PRS and PRB are set to be at positions bilaterally-symmetric with respect to the listener.

Figure 14A:
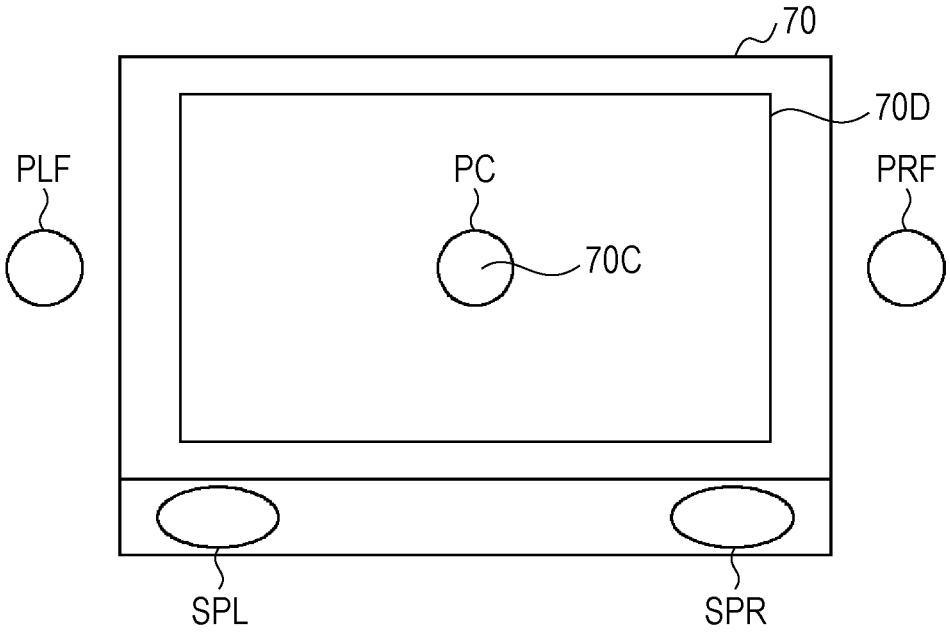
FIGS. 14A and 14B are outlined diagrams illustrating speaker arrangement examples (2) in 7.1-channel multi-surround.
Figure 14B:
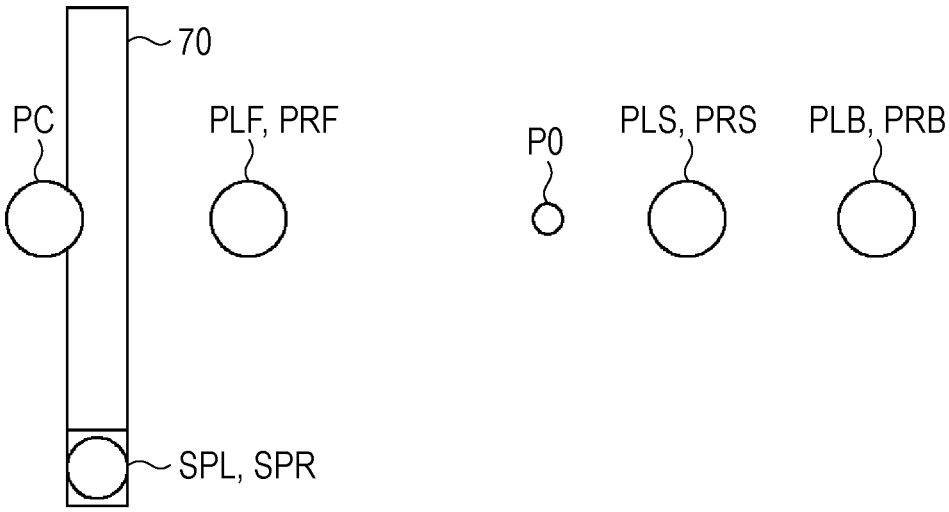

FIG. 14A illustrates a state as seen in a direction of the television apparatus 50 from the position of the listener in the speaker arrangement example of FIG. 13A. Also, FIG. 14B illustrates a state as the speaker arrangement example of FIG. 14A is seen from the lateral side.

That is, in this arrangement example, the speaker positions PC, PLF, PRF, PLS, PRS, PLB, and PRB are arranged at a height substantially equal to the display center 70C of the television apparatus 70.

For reference's sake, as a speaker for a low-frequency effect channel (hereinafter, which will be referred to as LFE (Low Frequency Effect) channel) has a low directivity in the sound of the low-frequency component, the speaker can be arranged at an arbitrary position.

3-3. Circuit Configuration of Television Apparatus

Figure 15:
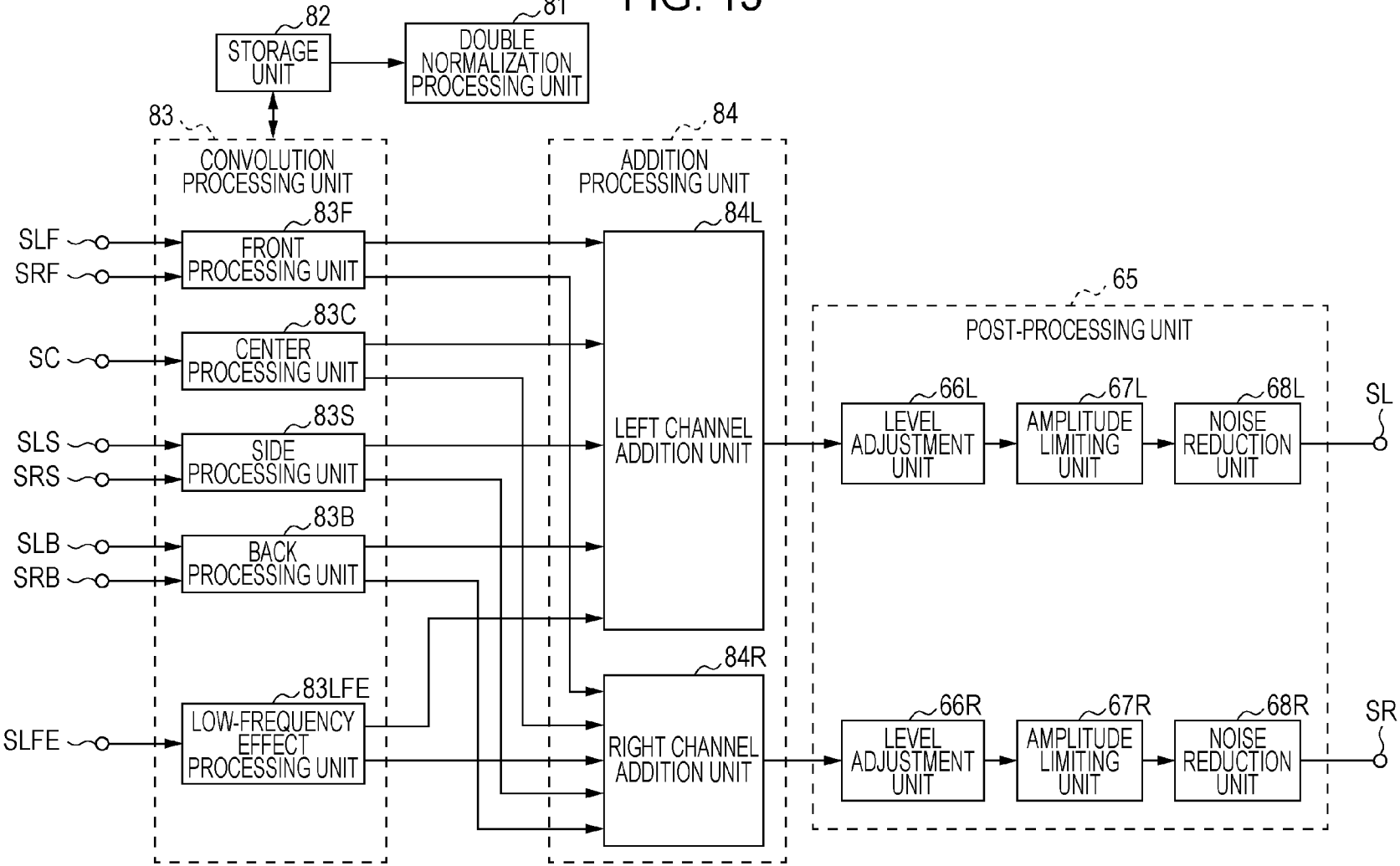
FIG. 15 is an outlined block diagram illustrating a configuration of a sound signal processing unit according to a second embodiment.

The television apparatus 70 is adapted to apply various computation processings and the like on the sound signals in the respective channels by a sound signal processing unit 80 illustrated in FIG. 15 corresponding to FIG. 10 to be then supplied to the left and right speakers SPL and SPR.

The sound signal processing unit 80 has a storage unit 82 and a convolution processing unit 83 respectively corresponding to the storage unit 62 and the convolution processing unit 63 in addition to the post-processing unit 65 similar to the sound signal processing unit 60 (FIG. 10) according to the first embodiment.

Furthermore, the sound signal processing unit 80 has a double normalization processing unit 81 that generates a double normalized head related transfer function and an addition processing unit 84 that generates 2-channel sound signals from 7.1-channel sound signals.

The storage unit 82 stores the head related transfer function H and the pristine state transfer characteristic T measured in the various assumed sound source direction positions by the head related transfer function measurement system 1 (FIGS. 2A and 2B).

Also, the storage unit 82 also stores the head related transfer function H and the pristine state transfer characteristic T in the real sound source direction positions (that is, the positions of the left and right speakers SPL and SPR in the television apparatus 70) which are similarly measured by the head related transfer function measurement system 1.

When the 2-channel sound signals are generated in reality on the basis of the 7.1-channel sound signals, the sound signal processing unit 80 first generates a double head related transfer function on which the measurement normalization processing, the localization normalization processing, and the dimension transform processing are applied by the double normalization processing unit 81 on the basis of the head related transfer function H and the pristine state transfer characteristic T.

After that, when the 7.1-channel sound signals are supplied, the sound signal processing unit 80 is adapted to convolve the double head related transfer function by the convolution processing unit 83 to be transformed from the 7.1 channels into the 2 channels by the addition processing unit 84 and supply the 2-channel sound signals to the left and right speakers SPL and SPR via the post-processing unit 65.

3-3-1. Configuration of Double Normalization Processing Unit

The double normalization processing unit 81 is adapted to generate the double normalized head related transfer function HN2 on the basis of the head related transfer function and the pristine state transfer characteristics in each of the assumed sound source direction position and the real sound source direction position.

Figure 16:
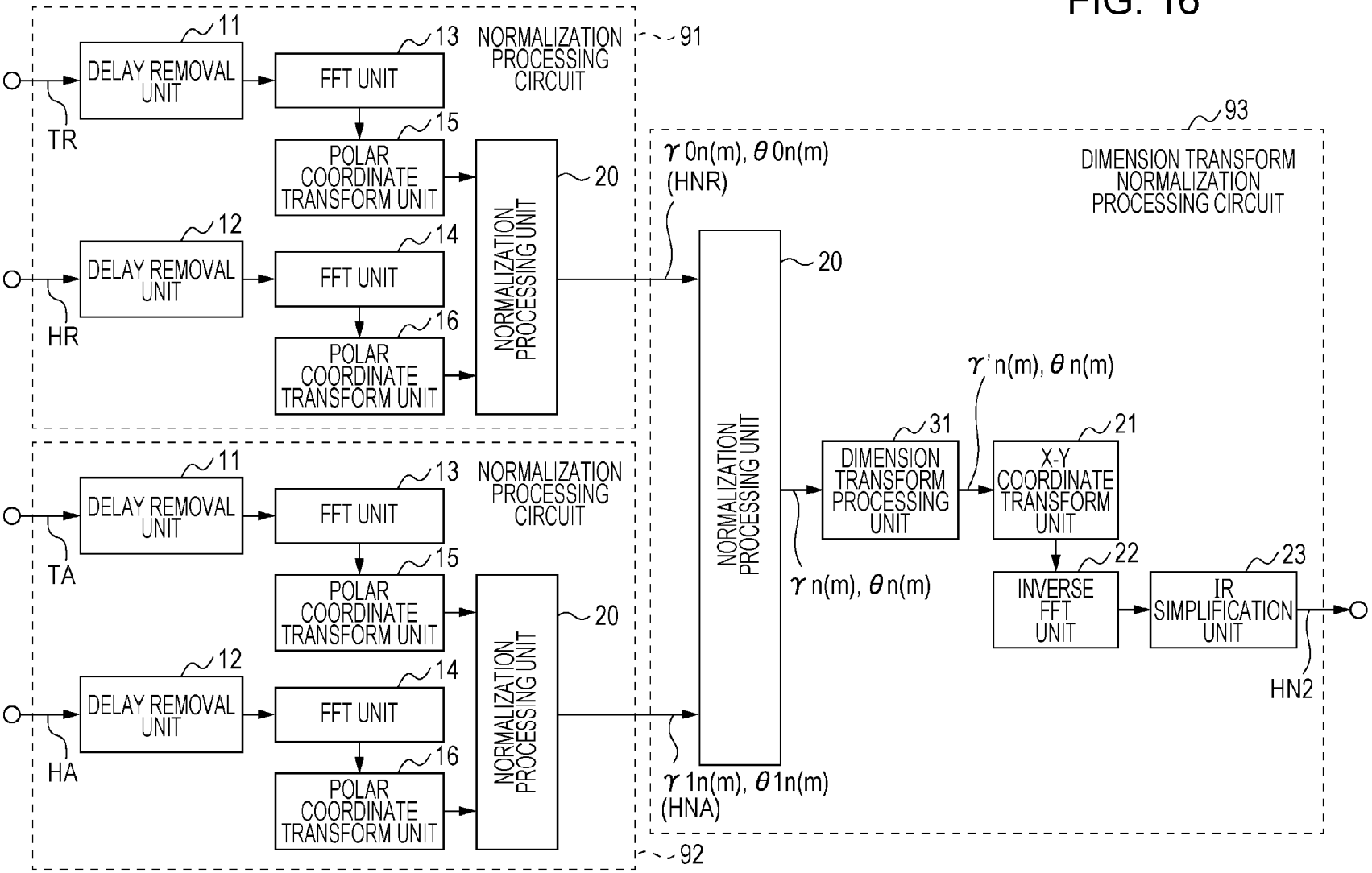
FIG. 16 is an outlined block diagram illustrating a configuration of a double normalization processing unit.

As illustrated in FIG. 16 corresponding to the overview of the double normalization processing illustrated in FIG. 11, the double normalization processing unit 81 has a configuration in which two normalization processing circuits 91 and 92 equivalent to the normalization processing circuits 10R and 10A are combined with a dimension transform normalization processing circuit 93 equivalent to the dimension transform normalization processing circuit 30.

The normalization processing circuit 91 is adapted to perform the measurement normalization processing on the real sound source direction position. As compared with the normalization processing circuit 10 (FIG. 4), the normalization processing circuit 91 similarly has the delay removal units 11 and 12, the FFT units 13 and 14, the polar coordinate transform units 15 and 16, and the normalization processing unit 20, but the X-Y coordinate transform unit 21, the inverse FFT unit 22, and the IR simplification unit 23 are omitted.

For this reason, the normalization processing circuit 91 generates data of the polar coordinate system representing the real normalized head related transfer function HNR (hereinafter, these will be set to as a radius vector $\gamma 0n(m)$ and a deflection angle $\theta 0n(m)$) through a computation processing similar to that of the normalization processing circuit 10 and supplies these to the dimension transform normalization processing circuit 93 as they are.

Also, the normalization processing circuit 92 is adapted to perform the measurement normalization processing on the assumed sound source direction position. The normalization processing circuit 92 has a circuit configuration similar to the normalization processing circuit 91.

For this reason, the normalization processing circuit 92 generates data of the polar coordinate system representing the assumed normalized head related transfer function HNA (hereinafter, these will be set to as a radius vector $\gamma 1n(m)$ and a deflection angle $\theta n(m)$) through the computation processing similar to that of the normalization processing circuit 10 and supplies these to the dimension transform normalization processing circuit 93 as they are.

That is, the normalization processing circuits 91 and 92 dere to skip the latter half of the processing while taking into account the performance of the normalization processing using the data of the polar coordinate system in the dimension transform normalization processing circuit 93 which will be described below.

The dimension transform normalization processing circuit 93 is adapted to perform the processing of normalizing the assumed normalized head related transfer function HNA through the measurement of the real normalized head related transfer function HNR, that is, the localization normalization processing and also perform the dimension transform processing.

As compared with the dimension transform normalization processing circuit 30 (FIG. 6), the dimension transform normalization processing circuit 93 similarly has the normalization processing unit 20, the dimension transform processing unit 31, the X-Y coordinate transform unit 21, the inverse FFT unit 22, and the IR simplification unit 23, but the delay removal units 11 and 12, the FFT units 13 and 14, and the polar coordinate transform units 15 and 16 are omitted.

For this reason, the dimension transform normalization processing circuit 93 first supplies the data of the polar coordinate system of each of the real normalized head related transfer function HNR and the assumed normalized head related transfer function HNA, that is, the radius vector $\gamma 0n(m)$ and the deflection angle $\theta 0n(m)$ and the radius vector $\gamma 1n(m)$ and the deflection angle $\theta 1n(m)$ to the normalization processing unit 20.

That is, as the data supplied from the normalization processing circuits 91 and 92 respectively is already in the polar coordinate system format, the dimension transform normalization processing circuit 93 skips the first half of the processing in the dimension transform normalization processing circuit 30.

For reference's sake, the real normalized head related transfer function HNR in this stage and the assumed normalized head related transfer function HNA are still both in the dimension of the power.

As the normalization processing in the second stage, the normalization processing unit 20 calculates each of the radius vector $\gamma n(m)$ after the normalization processing and the deflection angle $\theta n(m)$ after the normalization processing by performing the normalization processing while following Expression (10) and Expression (11) below respectively corresponding to Expression (1) and Expression (2) and supplies these to the dimension transform processing unit 31.

$$\gamma n(m) = \frac{\gamma 1(m)}{\gamma 0(m)} \tag{10}$$

$$\theta n(m) = \theta 1(m) - \theta 0(m) \tag{11}$$

Similarly as in the case of the dimension transform normalization processing circuit 30, the dimension transform processing unit 31 transforms the radius vector $\gamma n(m)$ after the normalization processing which is calculated by the normalization processing unit 20 into the radius vector $\gamma' n(m)$ by calculating a square root while following the above-mentioned Expression (9). That is, the radius vector $\gamma' n(m)$ is transformed from the dimension of the power into the dimension of the voltage.

Subsequently, the dimension transform processing unit 31 supplies the calculated radius vector $\gamma' n(m)$ and the deflection angle $\theta n(m)$ supplied as it is to the X-Y coordinate transform unit 21.

After that, the X-Y coordinate transform unit 21, the inverse FFT unit 22, and the IR simplification unit 23 generate the double normalized head related transfer function HN2 by respectively performing a processing similar to that in the case of the dimension transform normalization processing circuit 30.

In this manner, during a period from the normalization processing in the first stage until the normalization processing in the second stage, the double normalization processing unit 81 according to the second embodiment passes over the data representing the respective normalized head related transfer functions while keeping the polar coordinate system, and it is configured to avoid wastes of the transform processing in the coordinate system and the FFT processing.

3-3-2. Configuration of Convolution Processing Unit

The convolution processing unit 83 (FIG. 15) performs the convolution processing on the double normalized head related transfer function generated through the double normalization processing to each of the 7.1-channel sound signals.

The convolution processing unit 83 is adapted to eliminate each of the influences of the speaker and the microphone at the time of the measurement of the head related transfer function by convolving the double normalized head related transfer function to the sound signal and also localize the sound image to the assumed sound source direction position.

At this time, in the convolution processing unit 83, with regard to the respective channels, it is configured that a delay processing equivalent to a predetermined period of time is carried out, and also the convolution processing of the normalized head related transfer function of the main component, the convolution processing of the normalized head related transfer function of the cross talk component, and a cross talk cancel processing are carried out.

For reference's sake, the cross talk cancel processing refers to a processing of cancelling out a physical cross talk component generated at the position of the listener when the sound signals are reproduced by the speaker SPL for the left channel and the speaker SPR for the right channel. Also, in the convolution processing unit 83, for simplification of the processing, the convolution processing on only the direct wave is set to be carried out, and the convolution processing related to the reflected wave is not carried out.

Incidentally, in FIG. 13A, the respective speaker positions of the front channel, the side channel, and the back channel on left and right are respectively bilaterally-symmetric with respect to a virtual center line passing through the speaker position PC of the center channel and the position P0 of the listener. Also, the positions of the left and right speakers SPL and SPR in the television apparatus 50 are bilaterally-symmetric.

For this reason, the television apparatus 50 can utilize the mutually equivalent normalized head related transfer functions on left and right in the convolution processing of the normalized head related transfer function, with regard to each of the front channel, the side channel, and the back channel.

In view of the above, in the following description, as a matter of convenience, the front channel, the side channel, and the back channel of the main components among the normalized head related transfer function in accordance with the assumed sound source direction position (hereinafter, which will be referred to as assumed normalized head related transfer function) are respectively denoted as F, S, and B without regard to left and right. Also, the center channel and the low-frequency effect channel among a normalized head related transfer function in accordance with the assumed sound source direction position (hereinafter, which will be referred to as assumed normalized head related transfer function) are respectively denoted as C and LFE.

Furthermore, the front channel, the side channel, and the back channel of the cross talk component of the assumed normalized head related transfer function are respectively denoted as xF, xS, and xB without regard to left and right, and the low-frequency effect channel is denoted as xLFE.

Also, with regard to the real normalized head related transfer function, the main component is denoted as Fref without regard to left and right, and the cross talk component is denoted as xFref.

By using these denotations, for example, the further normalization of an arbitrary assumed normalized head related transfer function through the double normalization processing with the normalized head related transfer function of the main component in accordance with the real sound source direction position can be represented as multiplication of 1/Fref with respect to the relevant arbitrary assumed normalized head related transfer function.

Furthermore, the convolution processing unit 83 is adapted to perform the convolution processing on the sound signal for each channel or mutually corresponding left and right two channels each. To be more specific, the convolution processing unit 83 has a front processing unit 83F, a center processing unit 83C, a side processing unit 83S, a back processing unit 83B, and a low-frequency effect processing unit 83LFE.

3-3-2-1. Configuration of Front Processing Unit

Figure 17:
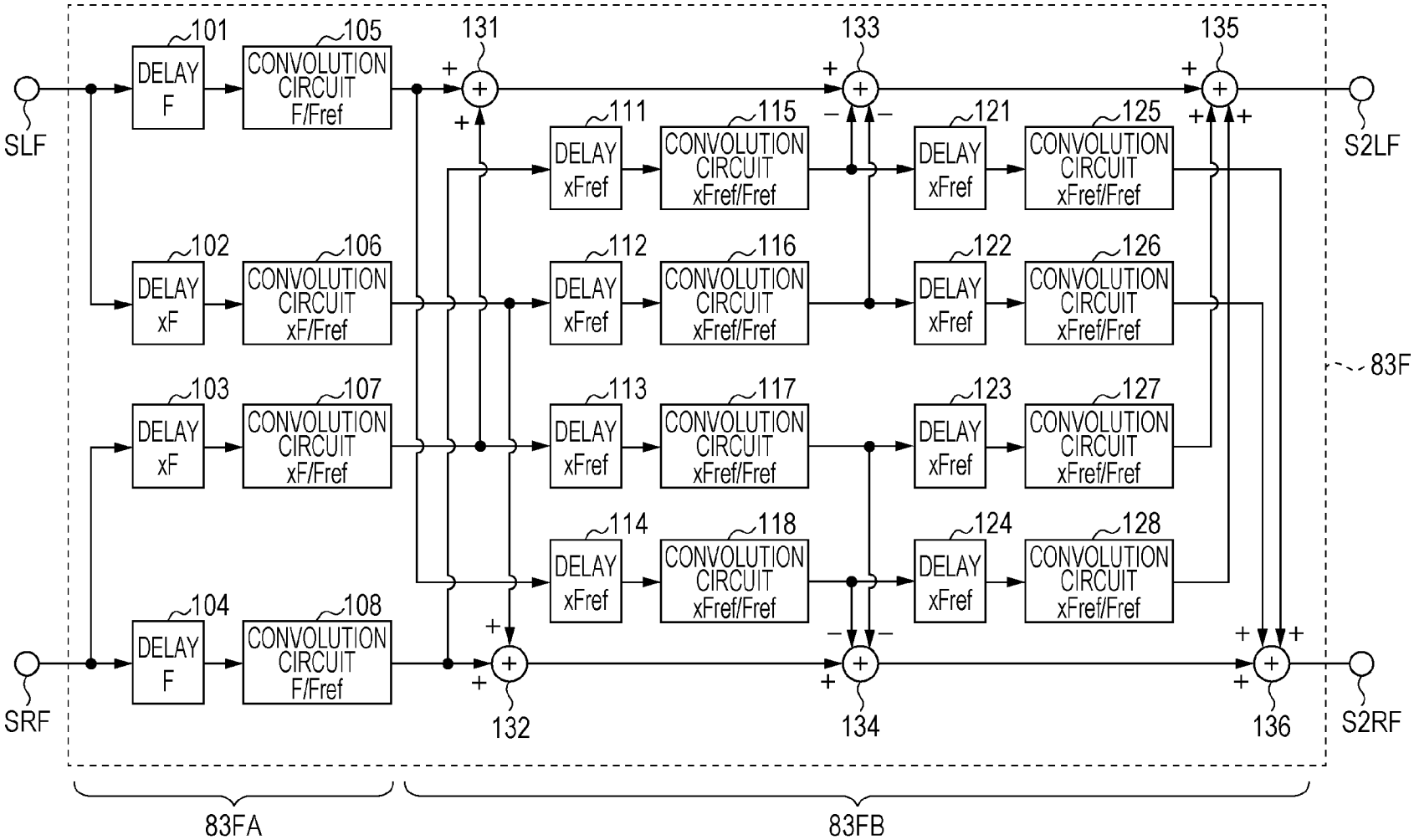
FIG. 17 is an outlined block diagram illustrating a circuit configuration of a front processing unit.

As illustrated in FIG. 17, the front processing unit 83F is adapted to perform the convolution processing of the normalized head related transfer function on each of the main component and the cross talk component with respect to a sound signal SLF in the left front channel and a sound signal SRF in the right front channel.

Also, the front processing unit 83F is roughly divided into a head related transfer function convolution processing unit 83FA in a mechanically former stage and a cross talk cancel processing unit 83FB in a latter stage, which are respectively composed of a plurality of delay circuits, convolution circuits, and adders in combination.

After the sound signal is delayed by a predetermined period of time, with regard to each of the main components and the cross talk components on left and right, the head related transfer function convolution processing unit 83FA is adapted to further normalize the assumed normalized head related transfer function with the real normalized head related transfer function (that is, the localization normalization) and also convolve the double normalized head related transfer function transformed into the dimension.

To be more specific, the head related transfer function convolution processing unit 83FA is constituted by delay circuits 101, 102, 103, and 104 and convolution circuits 105, 106, 107, and 108 composed, for example, of 80-tap IIR filters.

The delay circuit 101 and the convolution circuit 105 are adapted to perform the delay processing and the convolution processing on the sound signal SLF of the main component in the direct wave in the left front channel.

With regard to the main component in the left front channel, the delay circuit 101 delays the sound signal by the delay time in accordance with the path length from the virtual sound image localization position to the position of the listener. The above-mentioned delay processing corresponds to removal of the delay period of time in accordance with the relevant path length by the delay removal units 11 and 12 when the head related transfer function is generated in the normalization processing circuit 10 (FIG. 4) or the like, which provides an effect of reproducing, so to say, "a sense of distance from the virtual sound image localization position to the position of the listener".

With respect to the sound signal supplied from the delay circuit 101, the convolution circuit 105 normalizes a normalized head related transfer function F of the assumed sound source direction position with the normalized head related transfer function Fref at the real sound source direction position with regard to the main component in the left front channel and also convolves a double normalized head related transfer function F/Fref where the dimension transform is performed.

At this time, the convolution circuit 105 reads out the double normalized head related transfer function F/Fref that is previously generated by the double normalization processing unit 81 and stored in the storage unit 82 and performs a computation processing of convolving this to the sound signal, that is, the convolution processing. After that, the convolution processing unit 105 supplies the sound signal on which the convolution processing is applied to the cross talk cancel processing unit 83FB.

The delay circuit 102 and the convolution circuit 106 are adapted to perform the delay processing and the convolution processing on a sound signal xLF based on a cross talk from the left front channel to the right channel (hereinafter, which will be referred to as left front cross talk).

The delay circuit 102 delays the left front cross talk by the delay time in accordance with the path length from the assumed sound source direction position to the position of the listener.

With respect to the sound signal supplied from the delay circuit 102, the convolution circuit 106 normalizes the assumed normalized head related transfer function xF with a real normalized head related transfer function Fref with regard to the left front cross talk and also convolves a double normalized head related transfer function xF/Fref where the dimension transfer is performed.

At this time, the convolution circuit 106 reads out the double normalized head related transfer function xF/Fref that is previously generated by the double normalization processing unit 81 and stored in the storage unit 82 and performs a computation processing of convolving this to the sound signal. After that, the convolution processing unit 106 supplies the sound signal on which the convolution processing is applied to the cross talk cancel processing unit 83FB.

The delay circuit 103 and the convolution circuit 107 are adapted to perform the delay processing and the convolution processing on a sound signal xRF based on a cross talk from the left front channel to the left channel (hereinafter, which will be referred to as front right cross talk).

The delay circuit 103 and the convolution circuit 107 are respectively similarly configured like the delay circuit 102 and the convolution circuit 106 from the above-mentioned left-right symmetry with regard to FIG. 13A. For this reason, the delay circuit 103 and the convolution circuit 107 are configured to perform a delay processing similar to that by the delay circuit 102 on the sound signal in the front right cross talk and a convolution processing similar to that by the convolution circuit 106.

The delay circuit 104 and the convolution circuit 108 are adapted to perform the delay processing and the convolution processing on the sound signal SRF of the main component in the direct wave in the left front channel.

The delay circuit 104 and the convolution circuit 108 are respectively similarly configured like the delay circuit 101 and the convolution circuit 105 from the above-mentioned left-right symmetry with regard to FIG. 13A. For this reason, the delay circuit 104 and the convolution circuit 108 are configured to perform a delay processing similar to that by the delay circuit 101 on the sound signal SRF and a convolution processing similar to that by the convolution circuit 105.

After each of sound signals in four systems is delayed by a predetermined period of time, the cross talk cancel processing unit 83FB repeatedly performs the processing of convolving the double normalized head related transfer function obtained by further normalizing the assumed normalized head related transfer function with the real normalized head related transfer function with regard to the cross talk component in two stages. That is, the cross talk cancel processing unit 83FB is adapted to perform a second-order cancel processing on each of the sound signals in the four systems.

With regard to the cross talk (xFref) from the real sound source direction position, delay circuits 111, 112, 113, 114, 121, 122, 123, and 124 delay the sound signals respectively supplied thereto by the delay time in accordance with the path length from the real sound source direction position to the position of the listener.

With regard to the real sound source direction position, convolution circuits 115, 116, 117, 118, 125, 126, 127, and 128 normalize the normalized head related transfer function xFref of the cross talk component with the normalized head related transfer function Fref of the main component and also convolve a double normalized head related transfer function xFref/Fref where the dimension transform is performed to the sound signals respectively supplied thereto.

Adder circuits 131, 132, 133, 134, 135, and 136 add the respectively supplied sound signals.

Herein, sound signals S2LF and S2RF output from the front processing unit 83F can be respectively represented as the following Expression (12) and Expression (13).

$$S2LF = SLF \times D(F) \times F\left(\frac{F}{Fref}\right) + SRF \times D(xF) \times F\left(\frac{xF}{Fref}\right) - SLF \times D(xF) \times F\left(\frac{xF}{Fref}\right) \times K - SRF \times D(F) \times F\left(\frac{F}{Fref}\right) \times K + SLF \times D(F) \times F\left(\frac{F}{Fref}\right) \times K \times K + SRF \times D(xF) \times F\left(\frac{xF}{Fref}\right) \times K \times K \tag{12}$$

$$S2RF = SRF \times D(F) \times F\left(\frac{F}{Fref}\right) + SLF \times D(xF) \times F\left(\frac{xF}{Fref}\right) - SRF \times D(xF) \times F\left(\frac{xF}{Fref}\right) \times K - SLF \times D(F) \times F\left(\frac{F}{Fref}\right) \times K + SRF \times D(F) \times F\left(\frac{F}{Fref}\right) \times K \times K + SLF \times D(xF) \times F\left(\frac{xF}{Fref}\right) \times K \times K \tag{13}$$

It should be however noted that in Expression (12) and Expression (13), the delay processing is represented by D ( ) and the convolution processing is represented by F ( ), and also the delay processing and the convolution processing for the cross talk cancel are represented by a constant K in the following Expression (14).

$$K = D(xFref) \times F\left(\frac{xFref}{Fref}\right) \tag{14}$$

In this manner, the front processing unit 83F generates the sound signal S2LF for the left channel and the sound signal S2RF for the right channel and supplies these to the addition processing unit 84 (FIG. 15) in a latter stage.

3-3-2-2. Configuration of Center Processing Unit

Figure 18:
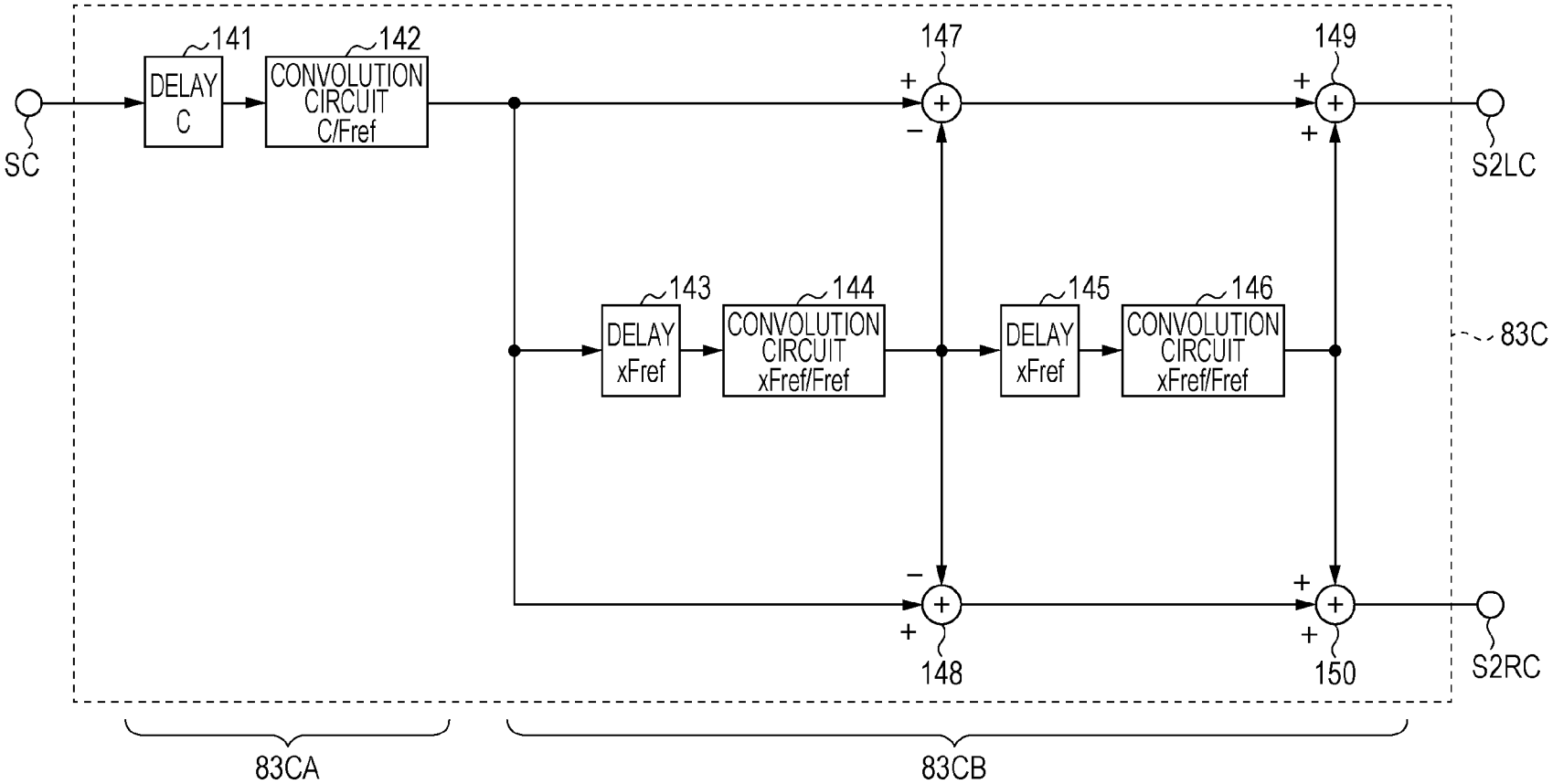
FIG. 18 is an outlined block diagram illustrating a circuit configuration of a center processing unit.

As illustrated in FIG. 18 corresponding to FIG. 17, with respect to a sound signal SC in the center channel, the center processing unit 83C is adapted to perform the convolution processing of the normalized head related transfer function with respect to the main component.

Also, like the front processing unit 83F, the center processing unit 83C is roughly divided into a head related transfer function convolution processing unit 83CA in a mechanically former stage and a cross talk cancel processing unit 83CB in a latter stage, which are respectively composed of a plurality of delay circuits, convolution circuits, and adders in combination.

After the sound signal is delayed by a predetermined period of time, like the head related transfer function convolution processing unit 83FA, the head related transfer function convolution processing unit 83CA is adapted to further normalize the normalized head related transfer function in the assumed sound source direction position with the normalized head related transfer function at the real sound source direction position with respect to the main component and also convolve the double normalized head related transfer function transformed into the dimension.

The head related transfer function convolution processing unit 83CA is constituted by a delay circuit 141 and a convolution circuit 142 composed, for example, of an 80-tap IIR filter and is are adapted to perform the delay processing and the convolution processing on the sound signal SC of the main component in the center channel.

With respect to the main component in the center channel, the delay circuit 141 delays the sound signal by the delay time in accordance with the path length from the virtual sound image localization position to the position of the listener.

With respect to the sound signal supplied from the delay circuit 141, the convolution circuit 142 normalizes the assumed normalized head related transfer function C related to the main component in the center channel with the real normalized head related transfer function Fref and convolves a double normalized head related transfer function C/Fref where the dimension transform is performed.

At this time, the convolution circuit 142 reads out the double normalized head related transfer function C/Fref that is previously generated by the double normalization processing unit 81 and stored in the storage unit 82 and performs a computation processing of convolving this to the sound signal, that is, the convolution processing. After that, the convolution processing unit 142 supplies the sound signal on which the convolution processing is applied to the cross talk cancel processing unit 83CB.

After the sound signal is delayed by a predetermined period of time, the cross talk cancel processing unit 83CB repeatedly performs a processing of further normalizing the assumed normalized head related transfer function with the real normalized head related transfer function and also convolving the double normalized head related transfer function transformed into the dimension with regard to the cross talk component in two stages.

With regard to the cross talk (xFref) from the real sound source direction position, delay circuits 143 and 145 delay the sound signals respectively supplied thereto by the delay time in accordance with the path length from the relevant real sound source direction position to the position of the listener.

With regard to the real sound source direction position, convolution circuits 144 and 146 normalize the normalized head related transfer function xFref of the cross talk component with the normalized head related transfer function Fref of the main component and also convolve the double normalized head related transfer function transformed into the dimension xFref/Fref to the sound signals respectively supplied thereto.

Adder circuits 147, 148, 149, and 150 add the respectively supplied sound signals.

In this manner, the center processing unit 83C generates a sound signal S2LC for the left channel and a sound signal S2RC for the right channel and supplies these to the addition processing unit 84 (FIG. 15) in a latter stage.

For reference's sake, the center processing unit 83C adds the sound signal SC in the center channel to both the left channel and the right channel. With this configuration, the sound signal processing unit 80 can improve the sense of localization of the sound in the center channel direction.

3-3-2-3. Configuration of Side Processing Unit

Figure 19:
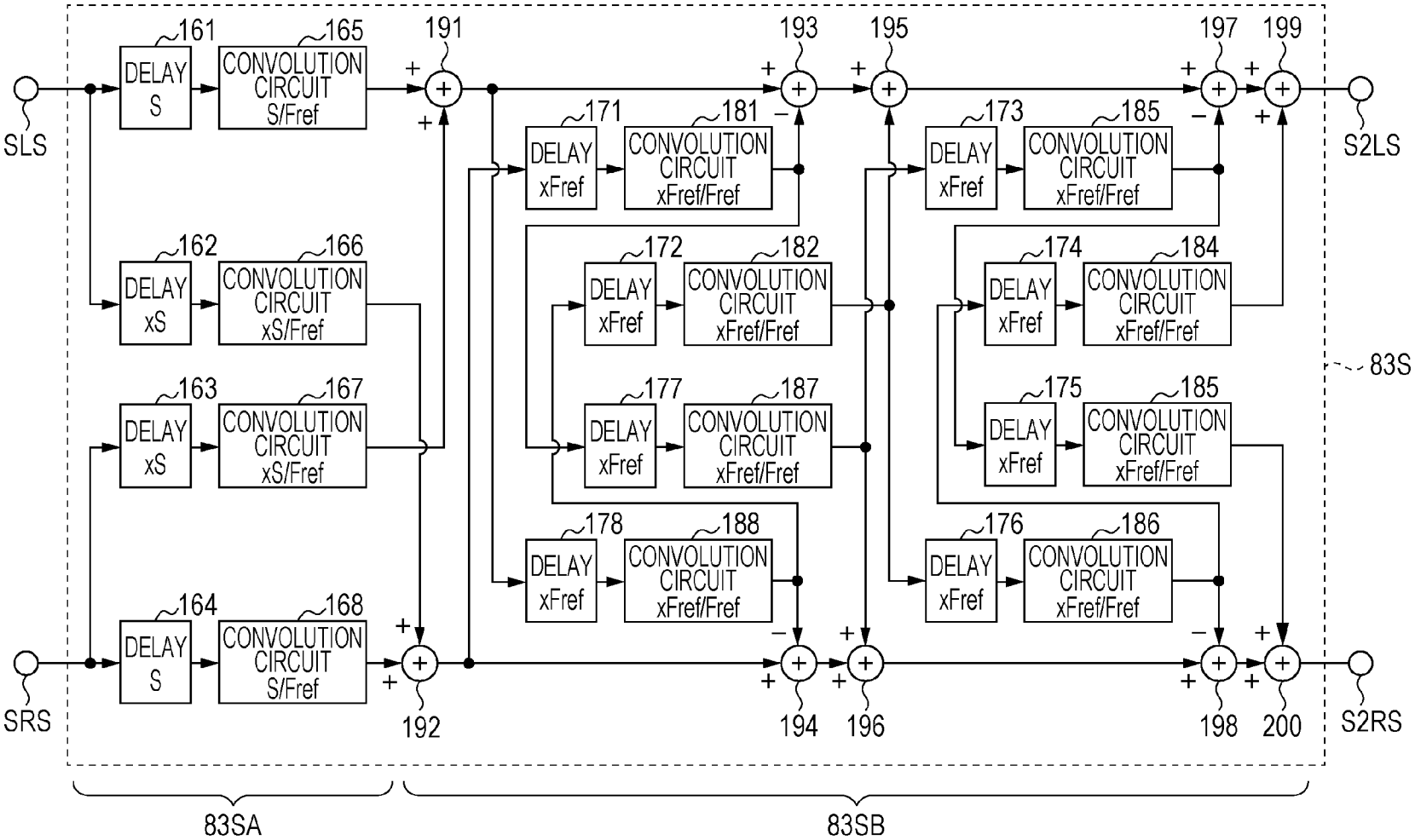
FIG. 19 is an outlined block diagram illustrating a circuit configuration of a side processing unit.

As illustrated in FIG. 19 corresponding to FIG. 17, the side processing unit 83S is adapted to perform the convolution processing of the normalized head related transfer function on each of the main component and the cross talk component with regard to a sound signal SLS in the left side channel and a sound signal SRS in the right side channel.

Also, the side processing unit 83S is roughly divided into a head related transfer function convolution processing unit 83SA in a mechanically former stage and a cross talk cancel processing unit 83SB in a latter stage, which are respectively composed of a plurality of delay circuits, convolution circuits, and adders in combination.

After the sound signal is delayed by a predetermined period of time, like the head related transfer function convolution processing unit 83FA, with regard to each of the main components and the cross talk components on left and right, the head related transfer function convolution processing unit 83SA is adapted to perform the processing of further normalizing the assumed normalized head related transfer function with the real normalized head related transfer function and also convolving the double normalized head related transfer function transformed into the dimension.

To be more specific, the head related transfer function convolution processing unit 83SA is constituted by delay circuits 161, 162, 183, and 184 and convolution circuits 165, 166, 167, and 168 composed, for example, of 80-tap IIR filters.

The delay circuits 161 to 184 and the convolution circuits 165 to 168 perform a computation processing in which the normalized head related transfer functions F and xF in the front channel are respectively replaced by the normalized head related transfer functions S and xS in the side channel with regard to the normalized head related transfer function at the assumed sound source direction position related to the main component and the cross talk in the delay circuits 101 to 104 and the convolution circuits 105 to 108.

At this time, the convolution circuits 165 to 168 read out a double normalized head related transfer function S/Fref or xS/Fref that is previously generated by the double normalization processing unit 81 and stored in the storage unit 82 and perform a computation processing of convolving this to the sound signal, that is, the convolution processing.

After the sound signal is delayed by a predetermined period of time, like the cross talk cancel processing unit 83FB, with regard to the cross talk component, the cross talk cancel processing unit 83SB is adapted to perform the processing of further normalizing the assumed normalized head related transfer function with the real normalized head related transfer function and also convolving the double normalized head related transfer function transformed into the dimension.

It should be however noted that unlike the cross talk cancel processing unit 83FB, the cross talk cancel processing unit 83SB is adapted to repeatedly perform a fourth cancel processing only on the sound signals in the two systems that are the main components, that is, the delay processing and the convolution processing in four stages.

Delay circuits 171, 172, 173, 174, 175, 176, 177, and 178 delay the sound signals respectively supplied thereto by the delay time in accordance with the path length from the real sound source direction position to the position of the listener with regard to the cross talk (xFref) from the real sound source direction position.

Convolution circuits 181, 182, 183, 184, 185, 186, 187, and 188 normalize the normalized head related transfer function xFref of the cross talk component with the normalized head related transfer function Fref of the main component with regard to the real sound source direction position and also convolve the double normalized head related transfer function transformed into the dimension xFref/Fref to the respectively supplied sound signals.

Adder circuits 191, 192, 193, 194, 195, 196, 197, 198, 199, and 200 add the respectively supplied sound signals.

In this manner, the side processing unit 83S generates a sound signal S2LS for the left channel and a sound signal S2RS for the right channel and supplies these to the addition processing unit 84 (FIG. 15) in a latter stage.

3-3-2-4. Configuration of Back Processing Unit

Figure 20:
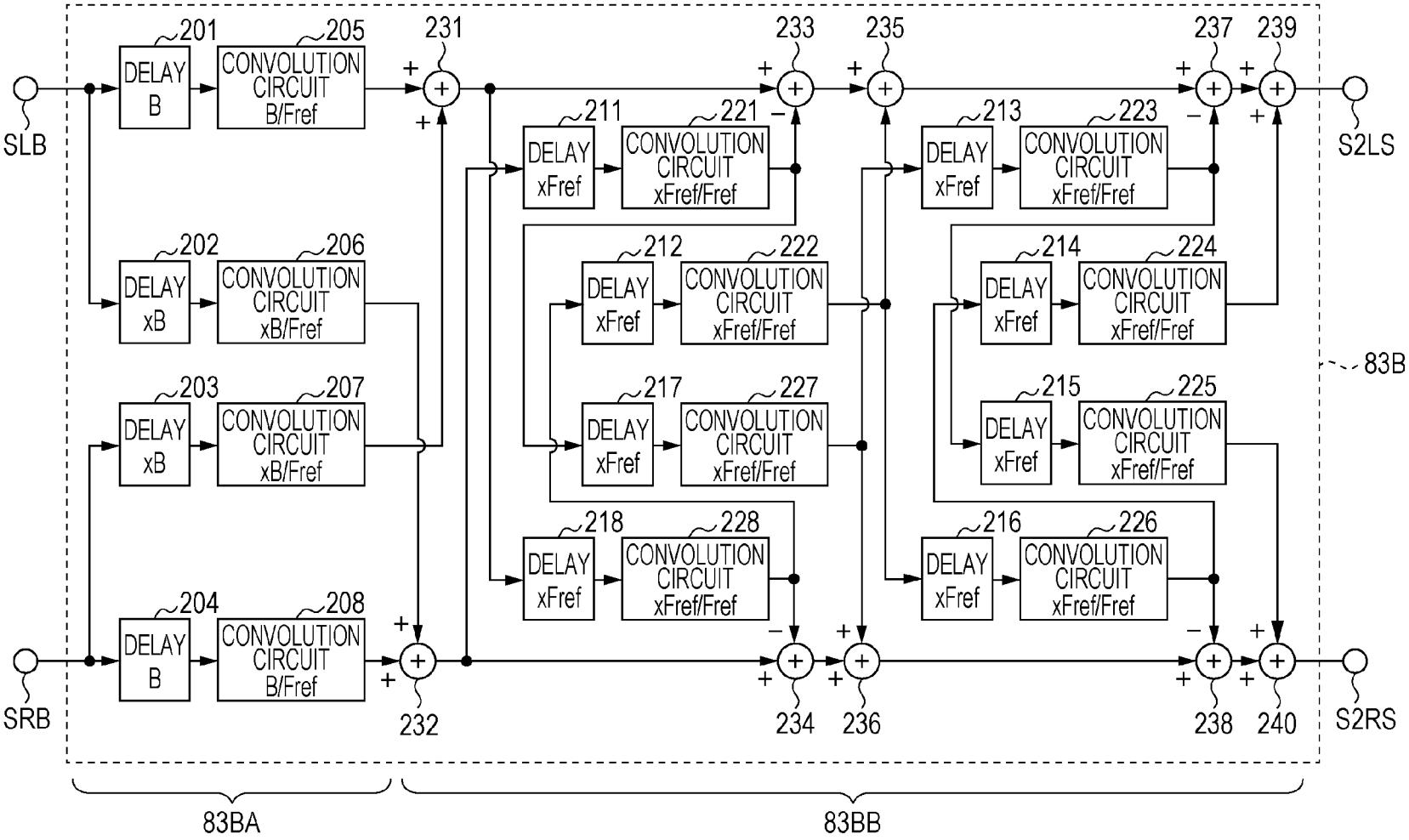
FIG. 20 is an outlined block diagram illustrating a circuit configuration of a back processing unit.

As illustrated in FIG. 20 corresponding to FIG. 19, the back processing unit 83B is adapted to perform the convolution processing of the normalized head related transfer function on each of the main component and the cross talk component with respect to a sound signal SLB in the left back channel and a sound signal SRB in the right back channel.

Also, the back processing unit 83B is roughly divided into a head related transfer function convolution processing unit 83BA in a mechanically former stage and a cross talk cancel processing unit 83BB in a latter stage, which are respectively composed of a plurality of delay circuits, convolution circuits, and adders in combination.

The head related transfer function convolution processing unit 83BA has a configuration corresponding to the head related transfer function convolution processing unit 83SA and is constituted by delay circuits 201, 202, 203, and 204 and convolution circuits 205, 206, 207, and 208 composed, for example, of 80-tap IIR filters.

The delay circuits 201 to 204 and the convolution circuits 205 to 208 performs a computation processing where the normalized head related transfer functions S and xS in the side channel are respectively replaced by the normalized head related transfer functions B and xB in the back channel with regard to the assumed normalized head related transfer function related to the main component and the cross talk component in the delay circuits 161 to 184 and the convolution circuits 165 to 168.

At this time, the convolution circuits 205 to 208 read out a double normalized head related transfer function B/Fref or xB/Fref that is previously generated by the double normalization processing unit 81 and stored in the storage unit 82 and perform a computation processing of convolving this to the sound signal, that is, the convolution processing.

The cross talk cancel processing unit 83BB is similarly configured as in the cross talk cancel processing unit 83SB and is adapted to perform the similar delay processing and the similar convolution processing.

That is, delay circuits 211, 212, 213, 214, 215, 216, 217, and 218 delay the sound signals supplied thereto by the delay time in accordance with the path length from the real sound source direction position to the position of the listener with regard to the cross talk (xFref) from the real sound source direction position.

Also, convolution circuits 221, 222, 223, 224, 225, 226, 227, and 228 normalize the normalized head related transfer function xFref of the cross talk component with the normalized head related transfer function Fref of the main component with regard to the real sound source direction position and also convolve the double normalized head related transfer function transformed into the dimension xFref/Fref to the sound signals respectively supplied thereto.

Adder circuits 231, 232, 233, 234, 235, 236, 237, 238, 239, and 240 add the respectively supplied sound signals.

In this manner, the back processing unit 83B generates a sound signal S2LB for the left channel and a sound signal S2RB for the right channel and supplies these to the addition processing unit 84 (FIG. 15) in a latter stage.

3-3-2-5. Configuration of Low-Frequency Effect Processing Unit

Figure 21:
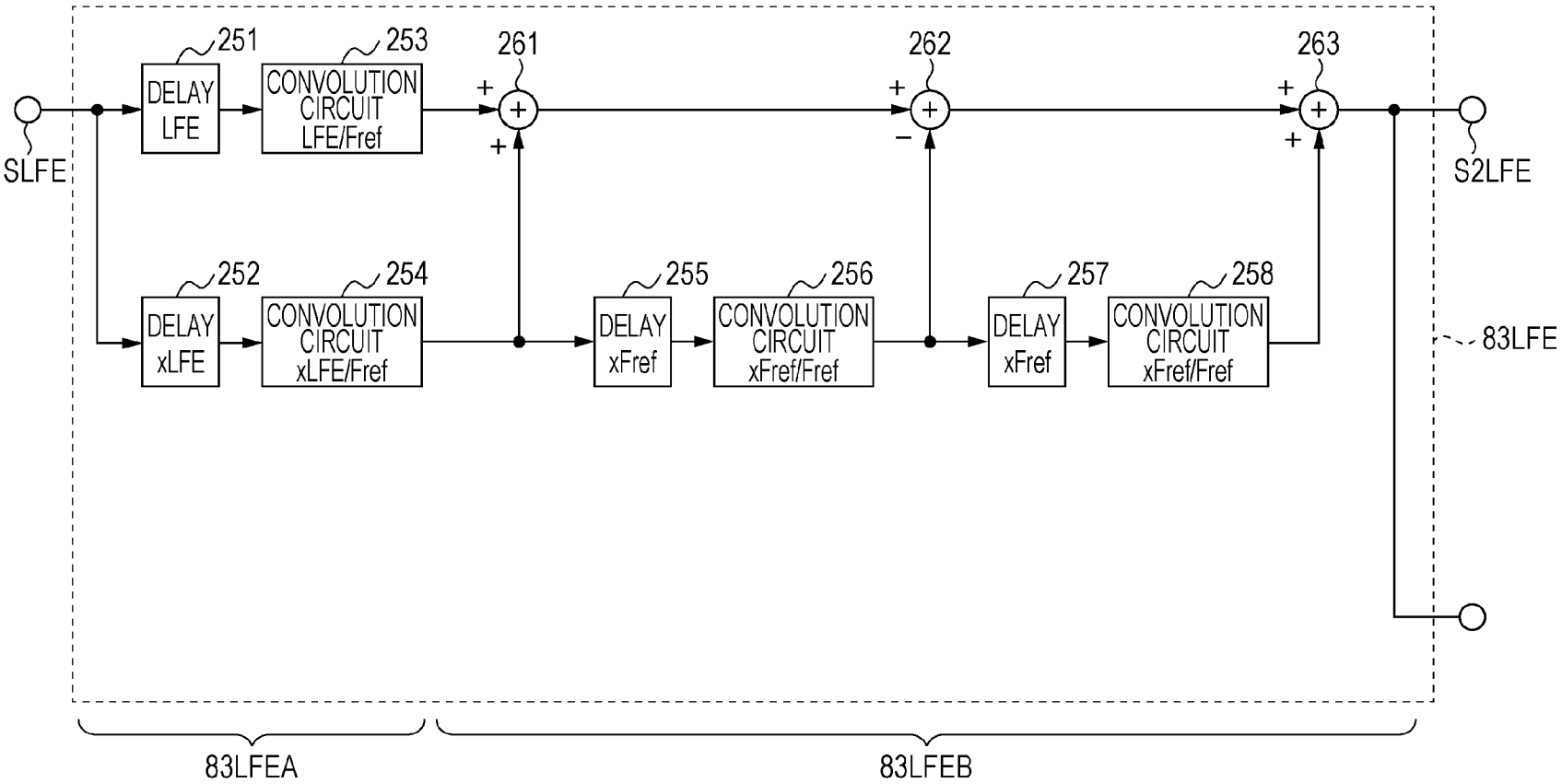
FIG. 21 is an outlined block diagram illustrating a circuit configuration of a low-frequency effect processing unit.

As illustrated in FIG. 21 corresponding to FIG. 17, with respect to a sound signal SLFE in the low-frequency effect channel, the low-frequency effect processing unit 83LFE is adapted to perform the convolution processing of the normalized head related transfer function with regard to each of the main component and the cross talk component.

Also, like the front processing unit 83F, the low-frequency effect processing unit 83LFE is roughly divided into a head related transfer function convolution processing unit 83LFEA in a mechanically former stage and a cross talk cancel processing unit 83LFEB in a latter stage, which are respectively composed of a plurality of delay circuits, convolution circuits, and adders in combination.

After the sound signal is delayed by a predetermined period of time, like the head related transfer function convolution processing unit 83FA, the head related transfer function convolution processing unit 83LFEA is adapted to perform the processing of further normalizing the assumed normalized head related transfer function with the real normalized head related transfer function with respect to each of the main component and the cross talk component and also convolving the double normalized head related transfer function transformed into the dimension.

The head related transfer function convolution processing unit 83LFEA is constituted by delay circuits 251 and 252 and convolution circuits 253 and 254 composed, for example, of 80-tap IIR filters and is adapted to perform the convolution processing on a sound signal SFE of the main component in the direct wave in the low-frequency effect channel.

The delay circuit 251 and the convolution circuit 253 are adapted to perform the delay processing and the convolution processing on the sound signal SLFE of the main component in the low-frequency effect channel.

The delay circuit 251 delays the sound signal by the delay time in accordance with the path length from the virtual sound image localization position to the position of the listener for the main component in the low-frequency effect channel.

With regard to the main component in the low-frequency effect channel, the convolution circuit 253 normalizes the normalized head related transfer function LFE at the assumed sound source direction position with the normalized head related transfer function Fref at the real sound source direction position with respect to the sound signal supplied from the delay circuit 141 and also convolves a double normalized head related transfer function LFE/Fref where the dimension transform is performed.

At this time, the convolution circuit 253 reads out the double normalized head related transfer function LFE/Fref that is previously generated in the double normalization processing unit 81 and stored in the storage unit 82 and performs a computation processing of convolving this to the sound signal, that is, the convolution processing. After that, the convolution processing unit 253 supplies the sound signal on which the convolution processing is applied to the cross talk cancel processing unit 83LFEB.

The delay circuit 252 and the convolution circuit 254 are adapted to perform the delay processing and the convolution processing on the sound signal xLFE for the cross talk in the direct wave in the low-frequency effect channel.

With regard to the cross talk component in the low-frequency effect channel, the delay circuit 252 delays the sound signal by the delay time in accordance with the path length from the virtual sound image localization position to the position of the listener.

With regard to the cross talk component in the low-frequency effect channel, the convolution circuit 254 normalizes the normalized head related transfer function xLFE at the assumed sound source direction position with the normalized head related transfer function Fref at the real sound source direction position with respect to the sound signal supplied from the delay circuit 252 and also convolves a double normalized head related transfer function xLFE/Fref where the dimension transform is performed.

At this time, the convolution circuit 254 reads out the double normalized head related transfer function xLFE/Fref that is previously generated in the double normalization processing unit 81 and stored in the storage unit 82 and performs a computation processing of convolving this to the sound signal. After that, the convolution processing unit 254 supplies the sound signal on which the convolution processing is applied to the cross talk cancel processing unit 83LFEB.

After the sound signal is delayed by a predetermined period of time, the cross talk cancel processing unit 83LFEB is adapted to repeatedly perform the processing of convolving the double normalized head related transfer function obtained by further normalizing the normalized head related transfer function at the assumed sound source direction position with the normalized head related transfer function at the real sound source direction position with regard to the cross talk in two stages.

Delay circuits 255 and 257 delay the sound signals respectively supplied thereto by the delay time in accordance with the path length from the real sound source direction position to the position of the listener with regard to the cross talk (xFref) from the real sound source direction position.

Convolution circuits 256 and 258 normalize the normalized head related transfer function xFref of the cross talk component with the normalized head related transfer function Fref of the main component with regard to the real sound source direction position and also convolve the double normalized head related transfer function transformed into the dimension xFref/Fref to the respectively supplied sound signals.

Adder circuits 261, 262, and 263 add the respectively supplied sound signals.

In this manner, the low-frequency effect processing unit 83LFE generates a sound signal S2LFE and distributes this to the left and right respective channels to be supplied to the addition processing unit 84 (FIG. 15) in a latter stage.

For reference's sake, the low-frequency effect processing unit 83LFE is adapted to add the sound signal SLFE in the low-frequency effect channel to both the left channel and the right channel while also taking into the cross talk. With this configuration, the sound signal processing unit 80 can reproduce the low-frequency sound component based on the sound signal LFE in the low-frequency effect channel to spread more widely.

3-3-3. Configuration of Addition Processing Unit

The addition processing unit 84 (FIG. 15) is composed of a left channel addition unit 84L and a right channel addition unit 84R.

The left channel addition unit 84L adds all sound signals S2FL, S2CL, S2SL, S2BL, and S2LFEL for the left channel which are supplied from the convolution processing unit 83 to generate a sound signal S3L and supplies this to the post-processing unit 65.

With this configuration, the left channel addition unit 84L is adapted to add the sound signals SLF, SLS, and SLB originally for the left channel and the cross talk components of the sound signals SRF, SRF, and SRB for the right channel with the sound signals SC and SLFE in the center channel and the low-frequency effect channel.

The right channel addition unit 84R adds all sound signals S2FR, S2CR, S2SR, S2BR, and S2LFER for the right channel which are supplied from the convolution processing unit 83 to generate a sound signal S3R and supplies this to the post-processing unit 65.

With this configuration, the right channel addition unit 84R is adapted to add the sound signals SRF, SRF, and SRB originally for the right channel and the cross talk components of the sound signals SLF, SLS, and SLB for the left channel with the sound signals SC and SLFE in the center channel and the low-frequency effect channel.

3-3-4. Configuration of Post-Processing Unit

Similarly as in the first embodiment, the post-processing unit 65 applies each of a level adjustment processing, an amplitude limiting processing, and a noise component reduction processing on the sound signals S3L and S3R to generate the sound signals S6L and S6R and supplies these to the speakers SPL and SPR (FIG. 14A) via an amplifier that is not illustrated in the drawing.

In accordance with this, the television apparatus 70 outputs the sounds based on the sound signals S6L and S6R from the left and right speakers SPL and SPR. As a result, the television apparatus 70 can provide the listening sense to the listener who listens to the relevant sounds from the speakers SPL and SPR as if the sound images are localized at the respective assumed sound source direction positions in the 7.1 channels.

3-4. Operations and Effects

In the above-mentioned configuration, according to the second embodiment, first, the head related transfer function measurement system 1 (FIGS. 2A and 2B) generates the head related transfer function H and the pristine state transfer characteristic T with respect to the real sound source direction position and the respective assumed sound source direction positions on the basis of the impulse response with regard to the direct wave in the anechoic chamber 2. Also, the storage unit 82 of the sound signal processing unit 80 stores the head related transfer function H and the pristine state transfer characteristic T.

When such an operation instruction or the like that the 7.1-channel sound signals should be reproduced is received, the television apparatus 70 performs the double normalization processing by the double normalization processing unit 81 of the sound signal processing unit 80 (FIG. 15) in accordance with the assumed sound source direction position and the real sound source direction position with regard to the respective channels.

That is, the normalization processing circuits 91 and 92 of the double normalization processing unit 81 (FIG. 16) normalize the head related transfer functions HA and HR with the pristine state transfer characteristics TA and TR with regard to each of the assumed sound source direction position and the real sound source direction position as the normalization processing in the first stage (the measurement normalization processing).

At this time, the normalization processing circuits 91 and 92 perform only the processing in the first half in the normalization processing circuit 10 (FIG. 4) and the normalized head related transfer functions HNA and HNR to a dimension transform normalization processing circuit in a state of the polar coordinate data represented by the frequency axis.

Subsequently, as the normalization processing in the second stage (the localization normalization processing), the dimension transform normalization processing circuit 93 of the double normalization processing unit 81 normalizes the assumed normalized head related transfer function HNA with the real normalized head related transfer function HNR and also generates the double normalized head related transfer function HN2 by performing the dimension transform processing. The generated double normalized head related transfer function HN2 is stored in the storage unit 82 (FIG. 15).

Then, when the 7.1-channel sound signals are supplied, the sound signal processing unit 80 reads out the double normalized head related transfer function HN2 in the respective channels from the storage unit, performs the convolution processing for each channel by the convolution processing unit 83, and generates the sound signals S3L and S3R in the 2-channel from the respective sound signals in the 7.1 channels by the addition processing unit 84.

After that, the sound signal processing unit 80 applies various signal processings on the sound signals S3L and S3R by the post-processing unit 65 and supplies the generated sound signals S6L and S6R to the speakers SPL and SPR so that the sounds are output.

Therefore, as it is possible to convolve the appropriate double normalized head related transfer function HN2 transformed into the dimension of the voltage to the 7.1-channel sound signals respectively, the television apparatus 70 can allow the listener to listen to the natural, high-quality sound without too much emphasis involved therein.

At this time, as the radius vector $\gamma n(m)$ after the normalization processing is supplied, by only calculating the square root while following Expression (9), the dimension transform processing unit 31 of the double normalization processing unit 81 can generate the radius vector $\gamma' n(m)$ correctly transformed from the dimension of the power into the dimension of the voltage.

Also, as the measurement normalization processing is carried out as the normalization processing in the first stage, the television apparatus 70 can appropriately eliminate the influences of the speaker and the microphone used for the measurement of the head related transfer function.

Furthermore, as the localization normalization processing is carried out, with the sounds output only from the speakers SPL and SPR at the real sound source direction positions, the television apparatus 70 can provide the sound image localization in which the respective speaker positions PC, PLF, PRF, PLS, PRS, PLB, and PRB (FIG. 13) are respectively set as the assumed sound source direction positions to the listener.

Also, in the double normalization processing unit 81 (FIG. 16), during a period from the normalization processing in the first stage until the normalization processing in the second stage, the data representing the normalized head related transfer function is passed over in the state of the polar coordinate system while being represented by the frequency axis.

For this reason, the double normalization processing unit 81 can omit the wasteful transform processing in which once the transform into the X-Y coordinate system is carried out, the transform into the polar coordinate system is carried out again, and also once the inverse FFT processing is carried out, the FFT processing is carried out again, which may occur in a case where the normalization processing circuit 10 and the dimension transform normalization processing circuit 30 are simply combined, and promote the efficiency of the computation processing.

Furthermore, as the double normalization processing unit 81 can calculate the square root in this state of the polar coordinate data, the mutual transform between the X-Y coordinate system and the polar coordinate data is not carried out for the computation of only the relevant square root.

According to the above-mentioned configuration, the television apparatus 70 according to the second embodiment convolves the double normalized head related transfer function HN2 generated through the measurement normalization processing, the localization normalization processing, and the dimension transform processing on the basis of the head related transfer function H with regard to the direct waves and the pristine state transfer characteristic T in respectively to the 7.1-channel sound signals and performs the addition processing on the sounds to be output from the two-channel speakers. With this configuration, similarly as in the first embodiment, the television apparatus 70 can respectively convolve the double normalized head related transfer function HN2 that is measured in the dimension of the power and transformed into the dimension of the voltage to the respective sound signals, allow the listener to listen to the high quality sound without too much emphasis involved therein, and can localize the sound image appropriately.

4. Other Embodiments

It should be noted that according to the above-mentioned first embodiment, the case has been described in which the measurement normalization processing and the dimension transform processing are performed to generate the normalized head related transfer function on the basis of the head related transfer function H and the pristine state transfer function T measured with respect to the direct waves in the anechoic chamber 2.

The present disclosure is not limited to this, and for example, in a case where the components of the reflected sound and the reverberant sound are small and at an ignorable level in the computation of the square root, on the basis of the head related transfer function H and the pristine state transfer function T measured in the measurement environment where the relevant reflected sound and reverberant sound may be generated, the normalized head related transfer function may also be generated by performing the measurement normalization processing and the dimension transform processing. The same applies to the second embodiment.

Also, according to the above-mentioned first embodiment, the case has been described in which the dimension transform processing is performed by computing the square root of the radius vector γn(m) after the polar coordinate data represented by the frequency axis is normalized through the measurement normalization processing.

Incidentally, when the square root with regard to each of both the side in Expression (1) is calculated to be deformed, the following Expression (15) can be derived.

$$\sqrt{\gamma n(m)} = \sqrt{\frac{\gamma(m)}{\gamma ref(m)}} = \frac{\sqrt{\gamma(m)}}{\sqrt{\gamma ref(m)}} \tag{15}$$

From this Expression (15), as the dimension transform processing, the square root may be calculated with regard to each of the radius vectors γ(m) and γref(m) before the normalization processing, and after that, division may be carried out as the normalization processing. In this case too, similarly as in the first embodiment, it is possible to obtain a computation result equivalent to the case in which the square root is calculated with regard to the radius vector γn(m) after the normalization processing.

To be more specific, the dimension transform processing unit 31 may be provided immediately before the normalization processing unit 20 instead of immediately after the normalization processing unit 20 in the dimension transform normalization processing circuit 30, the square root may be calculated with regard to each of the radius vectors γ(m) and γref(m) by the dimension transform processing unit 31, and these may be supplied to the normalization processing unit 20 to perform the division.

Also, according to the above-mentioned second embodiment, the case has been described in which the dimension transform processing is carried out when the normalization processing in the second stage, that is, the localization normalization processing is performed.

Figure 22:
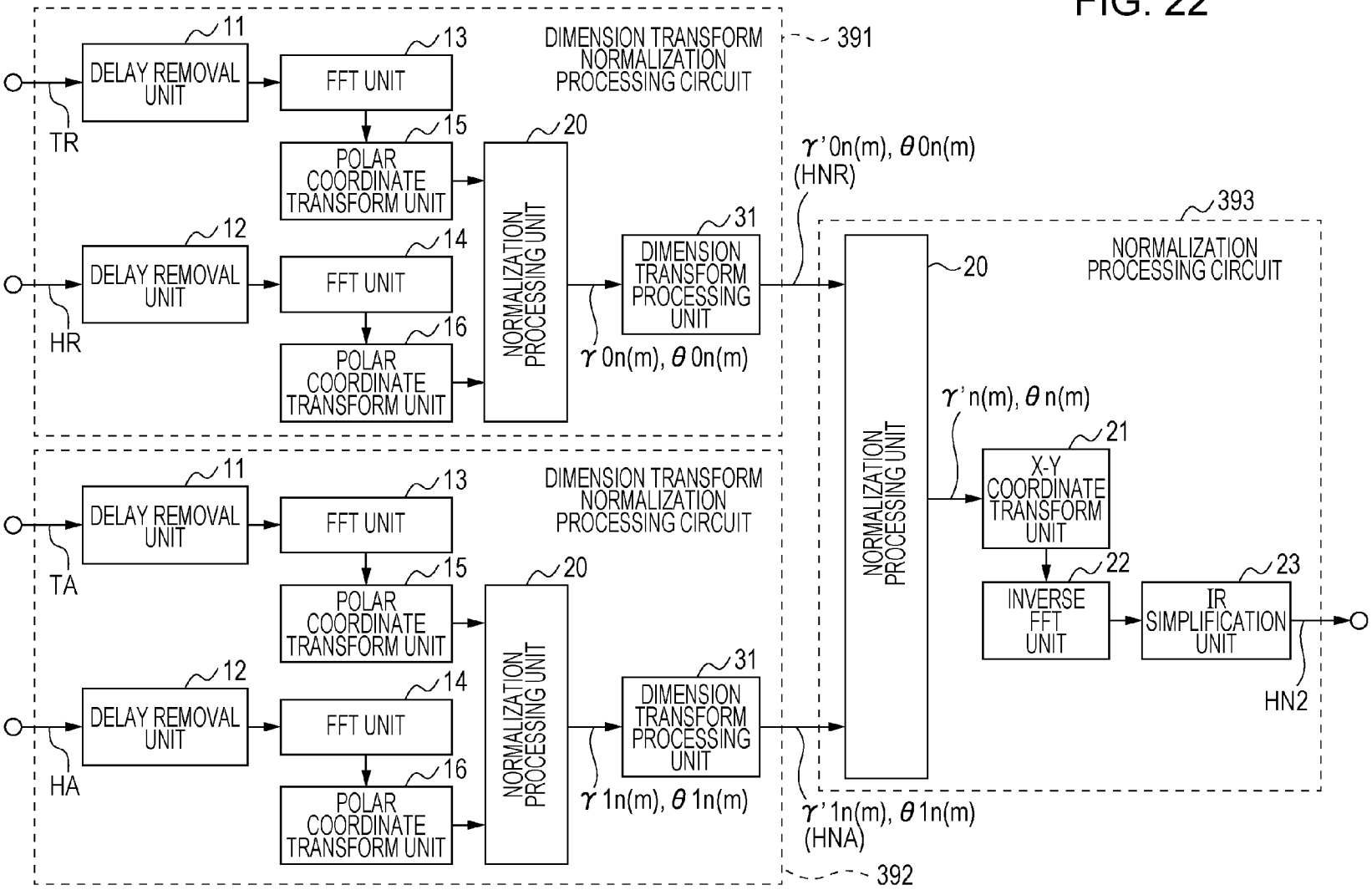
FIG. 22 is an outlined block diagram illustrating a configuration of a double normalization processing unit according to another embodiment.

The present disclosure is not limited to this, and for example, when the normalization processing in the first stage, that is, the measurement normalization processing is performed respectively, the dimension transform processing may also be performed. For example, as illustrated in FIG. 22 corresponding to FIG. 16, it is conceivable that in a double normalization processing unit 381, dimension transform normalization processing circuits 391 and 392 are provided as a former stage for performing the measurement normalization processing and the dimension transform processing and a normalization processing circuit 393 is provided as a latter stage for performing the measurement normalization processing.

In this case, the radius vectors γ'0$n(m)$ and γ'1$n(m)$ are generated by calculating each of square roots of the radius vectors γ0$n(m)$ and γ1$n(m)$ by the dimension transform processing units 31 of each of the dimension transform normalization processing circuits 391 and 392 to be supplied to the normalization processing unit 20 of the normalization processing circuit 393. With this configuration, the double normalization processing unit 381 can generate the radius vector γ'n(m) similar to that of the second embodiment and eventually generate the double normalized head related transfer function HN2.

Furthermore, according to the second embodiment, the case has been described in which the polar coordinate data is supplied from each of the normalization processing circuits 91 and 92 in the former stage to the dimension transform normalization processing circuit 93 in the latter stage.

The present disclosure is not limited to this, and for example, in accordance with a data capacity, a speed of a data bus, or the like, the transform from the polar coordinate data into the orthogonal coordinate data may be carried out in the normalization processing circuits 91 and 92 in the former stage, or further, the transform into the time-axis data may be carried out through the inverse FFT processing to be supplied to the dimension transform normalization processing circuit 93 in the latter stage.

Furthermore, according to the above-mentioned second embodiment, the case has been described in which with regard to each of the real sound source direction position and the assumed sound source direction position, the head related transfer function H and the pristine state transfer characteristic T are stored in the storage unit 82, and these are read out in the stage where the double normalized head related transfer function HN2 is generated.

The present disclosure is not limited to this, and the head related transfer function H and the pristine state transfer characteristic T, for example, may be stored in the storage unit 82 in a state in which a part or all of the data removal processing for the head part, the FFT processing, and the polar coordinate transform processing are applied, and these may be read out when the double normalized head related transfer function HN2 is generated to perform the measurement normalization processing in the first stage.

Also, for example, the measurement normalization processing in the first stage may be performed in advance, and the normalized head related transfer function with regard to each of the real sound source direction position and the assumed sound source direction position may be generated to be stored in the storage unit 82. In this case, when the double normalized head related transfer function is generated, these normalized head related transfer functions may be read out by the double normalization processing unit 81 to be directly supplied to the dimension transform normalization processing circuit 30 in the latter stage. Also, the generated normalized head related transfer functions may be stored in the storage unit 82 in either state of the data of the polar coordinate system, the data of the orthogonal coordinate system, or the data based on the time axis.

Furthermore, according to the above-mentioned second embodiment, the case has been described in which when the television apparatus 70 performs the reproduction processing on the 7.1-channel sound signals, after the double normalized head related transfer function is generated, the convolution processing is carried out.

The present disclosure is not limited to this, and for example, in the initial setting operation or the like of the television apparatus 70, when the user performs the setting on the sound signal processing on the 7.1-channel sound signals, for example, the double normalized head related transfer function may also be generated and stored in the storage unit 82 or the like. In this case, when the 7.1-channel sound signals are actually supplied, the television apparatus 70 may read out the already generated double normalized head related transfer function from the storage unit 82 to perform the convolution processing.

Furthermore, according to the above-mentioned second embodiment, the case has been described in which the 2-channel sound signals is generated and reproduced on the basis of the sound signal of 7.1-channel multi-surround (that is, 8 channels in total) while the arrangement of the speaker regulated by ITU-R (FIG. 13A) is set as the assumed sound source direction position.

Figure 13B:
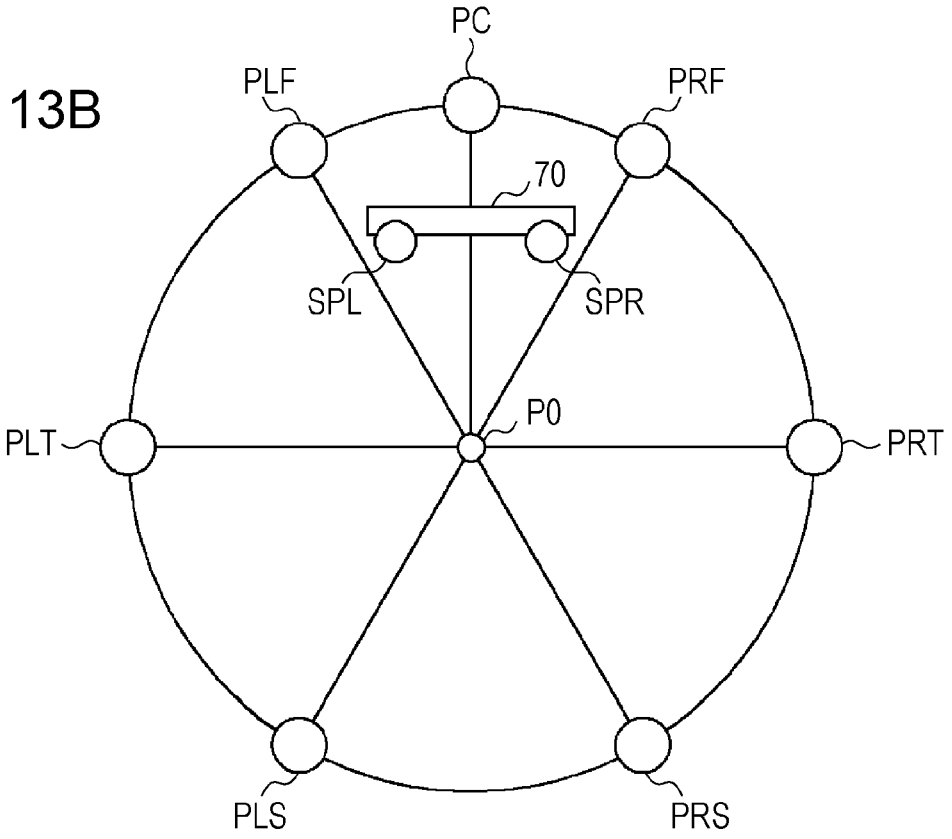

The present disclosure is not limited to this, and for example, as illustrated in FIG. 13B, the arrangement of the speaker recommended by THX Ltd. is set as the assumed sound source direction position, and also an arbitrary number of channels such as 5.1 channels or 9.1 channels and the 2-channel sound signals may be generated and reproduced on the basis of the sound signal in which an arbitrary speaker arrangement are supposed.

Also, the number of positions where the sound is actually reproduced from the speaker (the real sound source direction position), that is, the number of channels of the sound signals generated in the end is not limited to the 2 channels, and, for example, an arbitrary number of channels such as 4 channels or 5.1 channels may also be employed.

In these cases, in the convolution processing, the respective assumed sound source direction positions may be respectively normalized with the respective real sound source direction positions, and also the double normalized head related transfer function transformed into the dimension may be respectively convolved to the respective sound signals.

Furthermore, according to the above-mentioned second embodiment, the case has been described in which the same double normalized head related transfer function is used to perform the convolution processing with regard to the left and right corresponding channels by utilizing the situation where the assumed sound source direction position and the real sound source direction position are bilaterally-symmetric to each other when the listener faces the front.

The present disclosure is not limited to this, and for example, in a case where the assumed sound source direction position and the real sound source direction position are bilaterally-asymmetric to each other, the appropriate double normalized head related transfer functions corresponding to the respective assumed sound source direction positions and the respective real sound source direction positions may be respectively generated, and the convolution processing may be performed by using each of the appropriate double normalized head related transfer functions.

Furthermore, according to the above-mentioned first embodiment, the case has been described in which the impulse response Xn(m) is simplified into the 80 taps in the IR simplification unit 23 of the normalization processing circuit 10 and the dimension transform normalization processing circuit 30.

The present disclosure is not limited to this, and for example, the simplification into an arbitrary number of taps such as 160 taps or 320 taps may also be carried out. In this case, the number of taps may be decided appropriately in accordance with the computation processing performance of the DSP or the like that constitutes the convolution processing unit 63 of the sound signal processing unit 60. The same applies to the second embodiment.

Furthermore, according to the above-mentioned first embodiment, the case has been described in which digital data of 8192 samples with the sampling frequency of 96 [kHz] is generated in the sound signal processing unit 3 in the head related transfer function measurement system 1.

The present disclosure is not limited to this, and for example, digital data of an arbitrary number of samples such as 4096 samples or 16384 samples with an arbitrary sampling frequency such as 48 [kHz] or 192 [kHz] may also be generated. In particular, in this case, the number of samples and the sampling frequency may be decided in accordance with the number of taps or the like of the head related transfer function generated in the end.

Furthermore, according to the above-mentioned second embodiment, the case has been described in which in the respective cross talk cancel processing unit 83FB and the like of the convolution processing unit 83, the cross talk cancel processing composed of the delay processing and the convolution processing of the double head related transfer function is set to be carried out two times, that is, the second-order channel processing is carried out.

The present disclosure is not limited to this, and in the respective cross talk cancel processing unit 83FB and the like, an arbitrary number-order cancel processing may also be carried out in accordance with the position of the speaker SP, a physical restriction in a room, and the like.

Furthermore, according to the above-mentioned second embodiment, only the direct wave is convolved by the convolution processing unit 83 in the sound signal processing unit 80 of the television apparatus 70.

The present disclosure is not limited to this, and in the sound signal processing unit 80, the convolution processing may also be performed on the reflected waves by the wall surface, the ceiling surface, the floor surface, and the like.

That is, as illustrated by the broken line of FIG. 1, the direction in which the reflected wave from the direction of the assumed sound source direction position enters the microphone after being reflected at the reflection position such as the wall from the position where the virtual sound image localization is desired to be realized is thought to be the direction of the assumed sound source direction position with regard to the reflected wave. Then, as the convolution processing, the delay in accordance with the path length of the sound wave with regard to the reflected wave until the incidence to the microphone position from the direction of the assumed sound source direction position may be applied to the sound signal to convolve the normalized head related transfer function. The same applies to the second embodiment.

Furthermore, according to the above-mentioned first embodiment, the case has been described in which the present disclosure is applied to the television apparatus 50 functioning as the sound signal processing apparatus that generates the normalized head related transfer function on which the dimension transform processing is applied to be convolved to the sound signal.

The present disclosure is not limited to this, and for example, the present disclosure may also be applied to a head related transfer function generation apparatus that generates a normalized head related transfer function on which the dimension transform processing is applied on the basis of various types of the head related transfer function H and the pristine state transfer characteristic T. In this case, for example, the generated normalized head related transfer function may be stored in a television apparatus, a multichannel amplifier apparatus, or the like and the relevant normalized head related transfer function may be read out to perform the convolution processing on the sound signal. The same applies to the double normalized head related transfer function according to the second embodiment.

Furthermore, according to the above-mentioned embodiments, the case has been described in which the delay removal unit 11 functioning as a first input unit, the delay removal unit 12 functioning as a second input unit, and the normalization processing unit 20 and the dimension transform processing unit 31 functioning as a transform normalization processing unit constitute the television apparatus 50 functioning as a head related transfer function generation apparatus.

The present disclosure is not limited to this, and the first input unit, the second input unit, and the transform normalization processing unit which have other various configurations may also constitute the head related transfer function generation apparatus.

Furthermore, according to the above-mentioned embodiments, the case has been described in which the delay removal unit 11 functioning as a first input unit, the delay removal unit 12 functioning as a second input unit, the normalization processing unit 20 and the dimension transform processing unit 31 functioning as a transform normalization processing unit, the X-Y coordinate transform unit 21, the inverse FFT unit 22, and the IR simplification unit 23 functioning as a head related transfer function generation unit, and the convolution processing unit 63 functioning as the convolution processing unit constitute the television apparatus 50 functioning as a sound signal processing apparatus.

The present disclosure is not limited to this, and the first input unit, the second input unit, the transform normalization processing unit, the head related transfer function generation unit, and the convolution processing unit which have other various configurations may also constitute the sound signal processing apparatus.

The present disclosure contains subject matter related to that disclosed in Japanese Priority Patent Application JP 2010-135291 filed in the Japan Patent Office on Jun. 14, 2010, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A head related transfer function generation apparatus comprising:

a first input unit that inputs a first head related transfer function generated in a first measurement environment that includes a dummy head;

a second input unit that inputs a second head related transfer function generated in a second measurement environment that is free of a dummy head; and a transform normalization processing unit that:

generates a normalized gain by normalizing a first gain of the first head related transfer function represented in frequency-axis data with a second gain of the second head related transfer function represented in frequency-axis data, and reduces emphasis of a sound signal by performing a dimension transformation of the normalized gain from power to voltage by calculating a square root of the normalized gain.

2. The head related transfer function generation apparatus according to claim 1, wherein the first and second head related transfer functions are generated with regard to only direct waves in the first and second measurement environments.

3. The head related transfer function generation apparatus according to claim 1, wherein the first and second gains are radius vectors of the first and second head related transfer functions transformed in polar coordinates, and wherein the transform normalization processing unit divides the radius vector of the first head related transfer function by the radius vector of the second head related transfer function and also calculates a square root thereof and the transform normalization processing unit subtracts a deflection angle of the second head related transfer function from a deflection angle of the first head related transfer function.

4. The head related transfer function generation apparatus according to claim 3, wherein the transform normalization processing unit divides the radius vector of the first head related transfer function by the radius vector of the second head related transfer function and thereafter calculates a square root thereof.

5. The head related transfer function generation apparatus according to claim 3, wherein the transform normalization processing unit calculates square roots of each of the radius vector of the first head related transfer function and the radius vector of the second head related transfer function and thereafter divides the square root of the radius vector of the first head related transfer function by the square root of the radius vector of the second head related transfer function.

6. The head related transfer function generation apparatus according to claim 1, wherein the first head related transfer function relates to a direct wave to sound pickup units installed at locations of ears of the listener from a sound source installed at a predetermined sound source direction position and is a head related transfer function in a state in which the listener or a predetermined dummy head exists, and wherein the second head related transfer function relates to a direct wave from the sound source to the sound pickup units and is a transfer characteristic in a pristine state where the listener or the dummy head does not exist.

7. The head related transfer function generation apparatus according to claim 1, wherein the first head related transfer function is a head related transfer function related to a direct wave to sound pickup units installed at locations of ears of the listener from a sound source installed at a first sound source direction position, and wherein the second head related transfer function is a head related transfer function related to a direct wave from the sound source installed at a second sound source direction position different from the first sound source direction position to the sound pickup units.

8. The head related transfer function generation apparatus according to claim 7, wherein the first head related transfer function relates to the direct wave from the sound source installed at the first sound source direction position to the sound pickup units and is normalized with a pristine state transfer characteristic in a state in which the listener or a dummy head does not exist, and wherein the second head related transfer function relates to the direct wave from the sound source installed at the second sound source direction position to the sound pickup units and is normalized with a pristine state transfer characteristic in the state in which the listener or the dummy head does not exist.

9. A head related transfer function generation method comprising:

inputting a first head related transfer function generated in a first measurement environment that includes a dummy head and a second head related transfer function generated in a second measurement environment that is free of a dummy head;

generating a normalized gain by normalizing a first gain of the first head related transfer function represented in frequency-axis data with a second gain of the second head related transfer function represented in frequency-axis data; and reducing emphasis of a sound signal by performing a dimension transformation of the normalized gain from power to voltage by calculating a square root of the normalized gain.

10. A sound signal processing apparatus comprising:

a first input unit that inputs a first head related transfer function generated in a first measurement environment that includes a dummy head;

a second input unit that inputs a second head related transfer function generated in a second measurement environment that is free of a dummy head;

a transform normalization processing unit that:

generates a normalized gain by normalizing a first gain of the first head related transfer function represented in frequency-axis data with a second gain of the second head related transfer function represented in frequency-axis data, and reduces emphasis of a sound signal by performing a dimension transformation of the normalized gain from power to voltage by calculating a square root of the normalized gain to generate a transform normalized gain;

a head related transfer function generation unit that generates a normalized head related transfer function represented in time-axis data on the basis of the transform normalized gain; and a convolution processing unit that convolves the normalized head related transfer function to a sound signal.

11. The sound signal processing apparatus according to claim 10, wherein the first and second head related transfer functions are generated with respect to only direct waves in the first and second measurement environments.

12. The sound signal processing apparatus according to claim 11, further comprising:

a second transform normalization processing unit that normalizes a first reflection gain of a first reflection head related transfer function represented in frequency-axis data with a second reflection gain of a second reflection head related transfer function represented in frequency-axis data, wherein the first and second reflection head related transfer functions are generated with regard to a reflection wave in the first and second measurement environments, and also calculates a square root of the normalization result to generate a transform normalized reflection gain; and a second head related transfer function generation unit that generates a normalized reflection head related transfer function represented in time-axis data on the basis of the transform normalized reflection gain, wherein the convolution processing unit convolves the normalized head related transfer function and the normalized reflection head related transfer function to the sound signal.

* * * * *